US006584629B2

(12) United States Patent
Tsuji et al.

(10) Patent No.: US 6,584,629 B2
(45) Date of Patent: Jul. 1, 2003

(54) MULTIFUNCTIONAL BED

(75) Inventors: Hiroshi Tsuji, Jouyou (JP); Hisashi Kataoka, Kyoto (JP); Hiroshi Yamaguchi, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 59 days.

(21) Appl. No.: 09/834,917

(22) Filed: Apr. 16, 2001

(65) Prior Publication Data

US 2001/0029629 A1 Oct. 18, 2001

(30) Foreign Application Priority Data

Apr. 17, 2000 (JP) ..... 2000-115577
Apr. 17, 2000 (JP) ..... 2000-115578
Apr. 17, 2000 (JP) ..... 2000-115579

(51) Int. Cl.[7] ..... A61G 7/16
(52) U.S. Cl. ..... 5/618; 5/600
(58) Field of Search ..... 5/618, 600, 612, 5/613, 624, 81.1 R, 86.1, 424, 425, 428

(56) References Cited

U.S. PATENT DOCUMENTS 2,607,929 A * 8/1952 Balluff ..... 5/618
2,786,214 A * 3/1957 Armstrong ..... 5/430
3,138,805 A * 6/1964 Piazza ..... 5/618
3,376,066 A * 4/1968 Kernes ..... 5/428 X
3,767,260 A * 10/1973 Limpach ..... 297/411.3
4,240,169 A * 12/1980 Roos ..... 5/613
4,987,620 A * 1/1991 Sharon ..... 5/600
5,555,582 A * 9/1996 Jerideau ..... 5/600
6,272,702 B1 * 8/2001 Uchida et al. ..... 5/600
6,363,552 B1 * 4/2002 Hornbach et al. ..... 5/425
2001/0029629 A1 * 10/2001 Tsuji et al. ..... 5/618
2002/0095724 A1 * 7/2002 Hornbach et al. ..... 5/425

FOREIGN PATENT DOCUMENTS

JP 9-51921 2/1997

* cited by examiner

*Primary Examiner*—Robert G. Santos
(74) *Attorney, Agent, or Firm*—Armstrong, Westerman & Hattori, LLP

(57) ABSTRACT

In a multifunctional bed in which a variable bed that can be changed into a wheelchair form is fitted in a U-shaped fixed bed, when a seat back portion of the variable bed is laid or raised, the variable bed may assume an unstable position, thus hindering a smooth form change. The present invention provides a multifunctional bed comprising a variable bed 3 that can be changed into a wheelchair form and a fixed bed 2 in which the variable bed 3 can be removably fitted, wherein a holding member is provided between the fixed bed 2 and the variable bed 3, for holding a vertical position of the variable bed 3 relative to the fixed bed 2, and the holding member comprises a vertical pair of guide rails 141, 143 disposed on a left and right inner side surfaces of a notched recess portion 20*a* of the fixed bed 2 formed so as to appear substantially U-shaped, and guide rollers 131, 133 disposed on both sides of a seat back portion 34 of the variable bed 3.

9 Claims, 26 Drawing Sheets

MULTIFUNCTIONAL BED

FIELD OF THE INVENTION

The present invention relates to a multifunctional bed comprising a variable bed that can be changed into a wheelchair form and a fixed bed in which the variable bed can be removably fitted, and in particular, to a mechanism for holding the vertical position of the variable bed relative to the fixed bed.

BACKGROUND OF THE INVENTION

Various nursing beds for nursing facilities, hospitals, or homes have been developed and provided for patients who require nursing. These nursing beds allow a patient to lie thereon in a horizontal position and are configured so as to be bent into the form of a reclining seat.

If the conventional bed is used to move the patient to a different place, a wheelchair must be prepared and a lifter device must also be prepared so as to help the patient into or out from the wheelchair.

On the other hand, many attempts have been made to research and develop the multifunctional nursing beds having both a bed function and a wheelchair function, and measures have been proposed to minimize not only the patient's burdens but also the caregiver's burdens.

For example, these multifunctional nursing beds comprise a fixed bed and a movable bed that is installed in and removed from a U-shaped notched recess portion of the fixed bed so that the movable bed is changed from a horizontal bed form to a wheel chair form to allow the patient to move, thereby making it unnecessary for the patient to walk from the bed to the wheelchair.

When, however, a seat back portion of the variable bed, which is in the form of the wheelchair, is laid or raised while the variable bed is fitted in the notched recess portion of the fixed bed, the center of gravity of the weight of the patient may shift rearward from the position of rear wheels form to cause the variable bed to assume an unstable position while the form is being changed, thus hindering a smooth form change.

In view of these points, the present invention provides a multifunctional bed that can smoothly perform operations such as changing of the form of a variable bed fitted in a fixed bed.

SUMMARY OF THE INVENTION

The problems to be solved by the present invention have been mentioned, and means for solving the problems will be described.

The present invention provides a multifunctional bed comprising a variable bed that can be changed into a wheelchair form and a fixed bed in which the variable bed can be removably fitted, wherein a holding member is provided between the fixed bed and the variable bed, for holding a vertical position of the variable bed relative to the fixed bed.

The holding member comprises a lateral pair of guiding members disposed on an inner surface of a notched recess portion of the fixed bed formed so as to appear substantially U-shaped, and a pair of guided members disposed on both sides of a seat portion of the variable bed.

The guiding members comprise a vertical pair of guide rails and the guided members comprise guide rollers guided along the vertical pair of guide rails.

In the prior art, if the variable bed that assumes the wheelchair form as described previously is moved into the notched recess portion of the fixed bed, since it must be moved backward and rear wheels of the variable bed are typically not navigating wheels, position control such as the direction change of the variable bed is cumbersome. Thus, part of the variable bed may interfere with a corner portion or the like at a front end of the fixed bed to shock the variable bed, thereby making the patient feel uncomfortable.

It is an object of the present invention to eliminate these disadvantages allow the variable bed to move smoothly into the fixed bed. The present invention provides a multifunctional bed comprising a variable bed that can be changed into a wheelchair form and a fixed bed in which the variable bed can be removably fitted, wherein guide rollers are disposed at rear positions of a seat portion of the variable bed, for guiding the fixed bed so as to move into the notched recess portion.

The present invention also provides a multifunctional bed comprising a variable bed that can be changed into a wheelchair form and a fixed bed in which the variable bed can be removably fitted, wherein guide rollers for guiding the fixed bed so as to enter or leave a notched recess portion are disposed on a front and a rear positions of both sides of a seat portion of the variable bed.

The present invention also provides a multifunctional bed comprising a variable bed that can be changed into a wheelchair form and a fixed bed in which the variable bed can be removably fitted, wherein guide surfaces for guiding the variable bed so as to advance into a notched recess portion are formed in a left and right inner sides of a front end surface of the fixed bed, the front end surface having the notched recess portion opened therein.

In the prior art, the fixed bed has handrails installed along peripheries thereof so as to stand up therefrom, in order to prevent the patient from falling down from the bed surface when the patient tosses about. Thus, when the patient gets on and off from the multifunctional bed, the movable bed must be separated from the fixed bed or the handrails installed on the fixed bed so as to stand up therefrom must be avoided.

In view of these points, it is an object of the present invention to provide a multifunctional bed that enables easy nursing and operations when the patient on the bed is looked after.

The present invention provides a multifunctional bed comprising a variable bed that can be changed into a wheelchair form and a fixed bed in which the variable bed can be removably fitted, wherein handrails are provided along peripheries of the fixed bed so as to stand up therefrom and are movable.

The handrails are configured to slide along peripheral portions of the fixed bed.

The handrails are attached to the fixed bed by slidably fitting slide guides fixedly installed on the handrails, in rails provided along the peripheral portions of the fixed bed, and the handrail side or the fixed bed side has a stopper mechanism for regulating sliding of the handrails.

DETAILED DESCRIPTION OF THE PREFERRED EMBODIMENTS

Figure 1A:
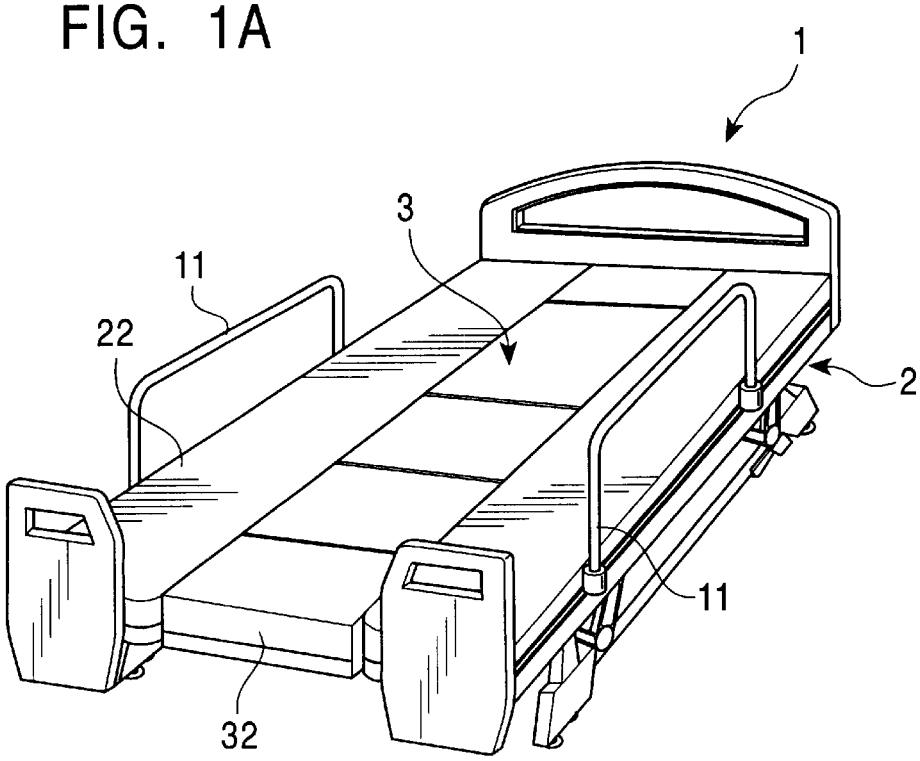
FIG. 1A is a perspective view of the entire functional bed in which a variable bed (a horizontal bed form) is fitted in a fixed bed.

A multifunctional bed according to the present invention will be described based on the specific embodiments shown in the drawings.

First, the basic structure of a multifunctional bed 1 according to the present invention will be explained.

As shown in FIGS. 1 to 5, the multifunctional bed 1 comprises a combination of two constituent members including a fixed bed 2 and a variable bed 3.

As shown in FIGS. 1 to 10, the fixed bed comprises a bedstead 20 and a leg portion 8 comprising a link mechanism 80 or the like, described later, which constitutes a leg stand 90 and a leg body and which enables the bedstead 20 to be elevated and lowered. The bed 20 comprises a left frame 21L and a right frame 21R and a rear frame 21B assembled together in the form of the character U as seen in a top view, and a mat 22 mounted on the assembled frames. The leg stand 90 is also U-shaped as seen in a top view, and has a open front portion and caster wheels 95, 95 . . . disposed on a bottom surface thereof at front and rear opposite ends. The leg stand 90 also has ground anchors 96, 96 . . . installed on the bottom surface thereof so as to extend perpendicularly from positions frontward and rearward outside the caster wheels 95, 95 . . .

The bedstead 20 has guard members 23, 23 and a guard member 24 installed on a front side thereof so as to stand up therefrom and to be arranged in a front-back direction (longitudinal direction), and handrails 11, 11 installed on both side surfaces of the guard members 23 and the guard member 24 so as to stand up therefrom and slide in the longitudinal direction. Further, the handrails 11, 11 may have a placement table 110 for table setting or the like installed on an upper side thereof so as to extend in a lateral direction and in this case, the placement table 110 may be rotationally moved in an upward lateral direction so as to stand up along outer side surfaces of the frames 21L, 21R for housing.

Figure 2:
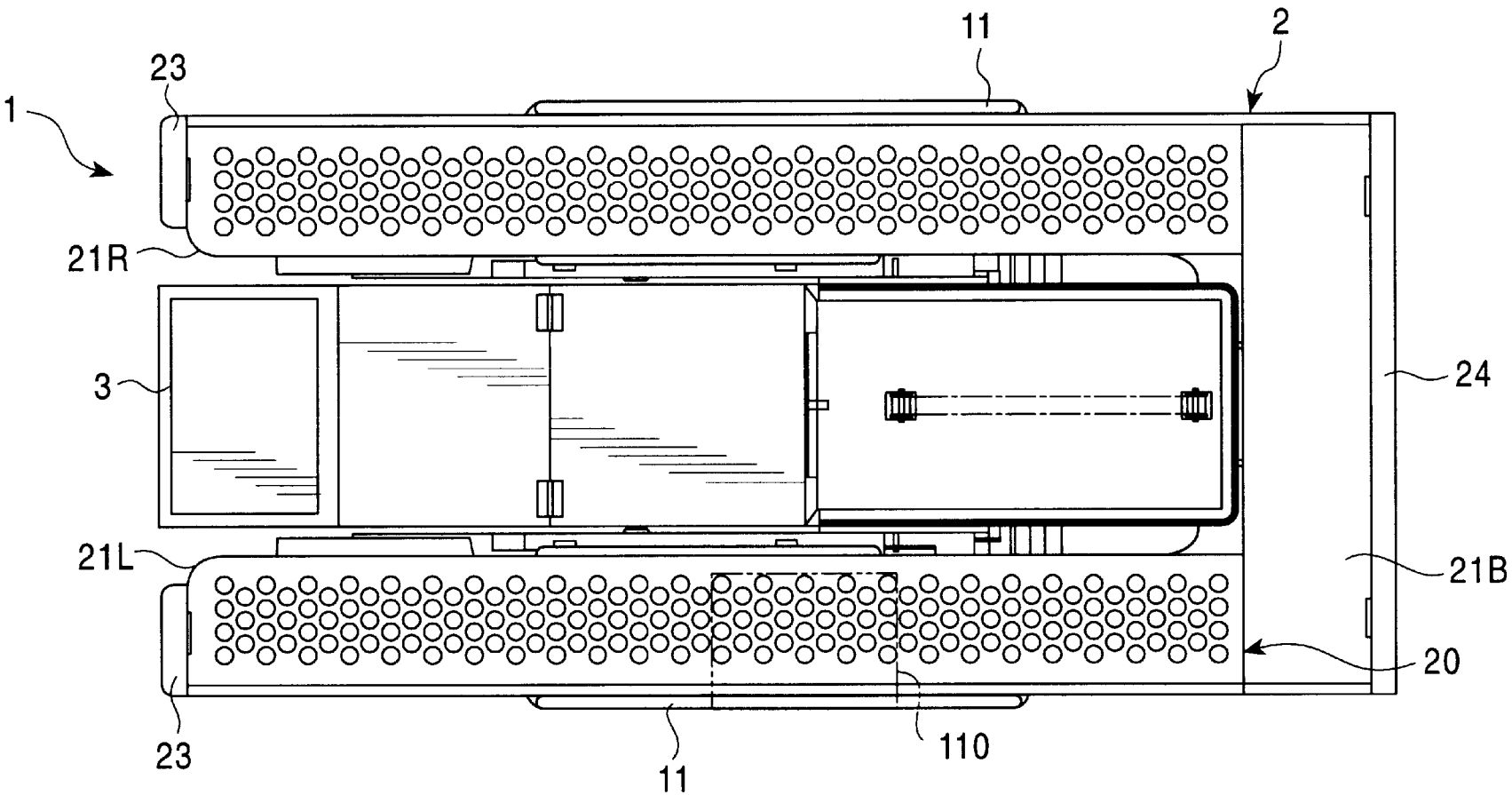
FIG. 2 is a top view of FIG. 1.
Figure 11:
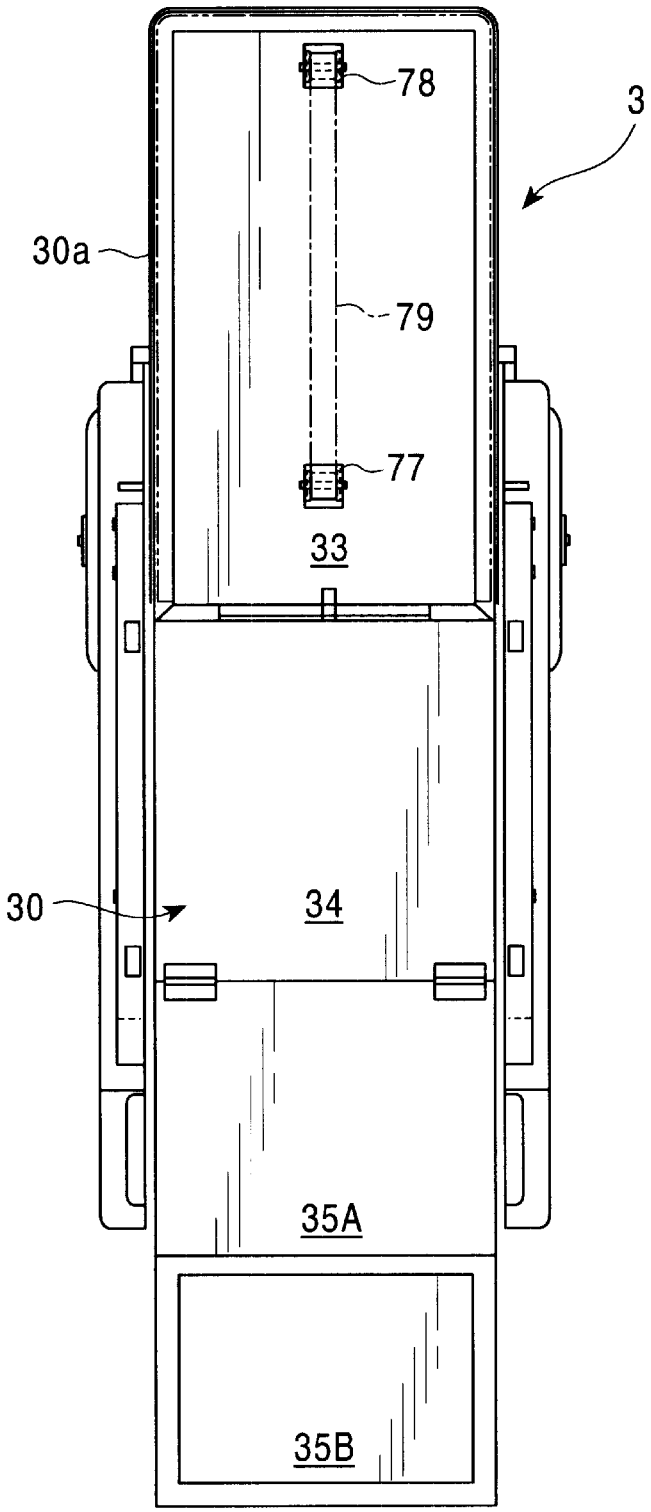
FIG. 11 is a top view showing a horizontal bed form of the variable bed.
Figure 12:
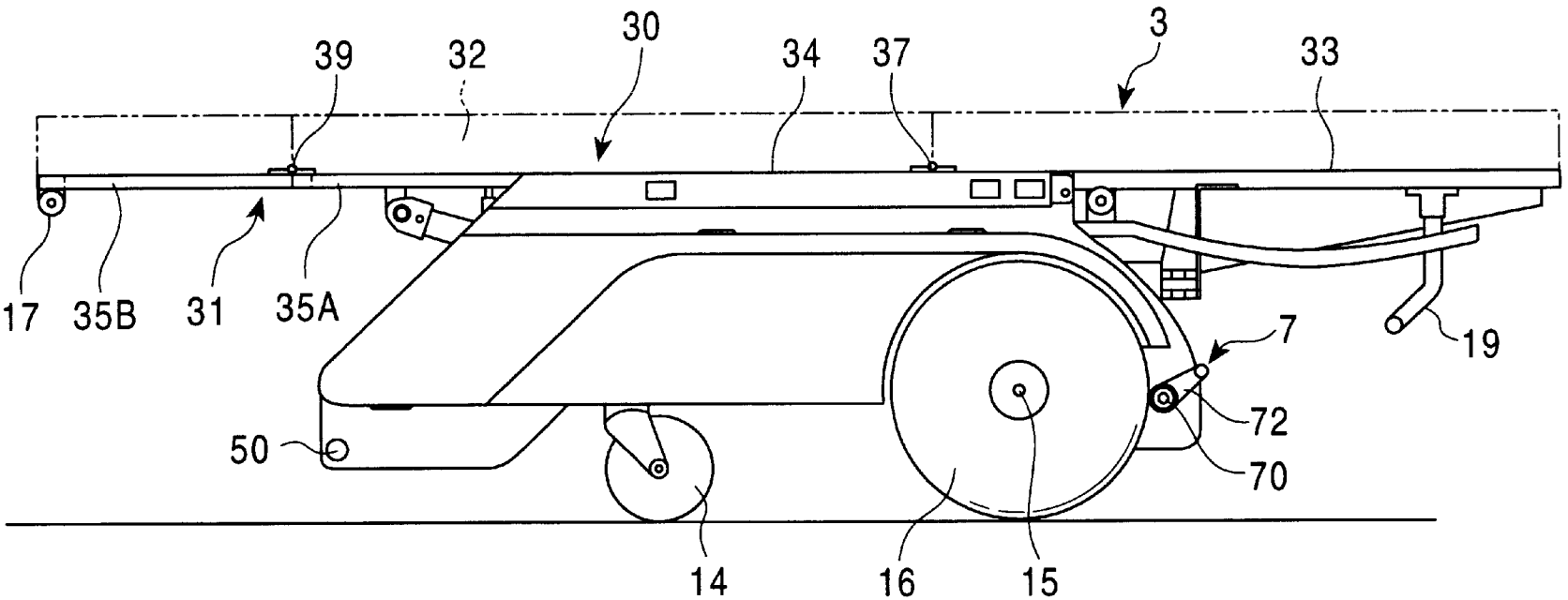
FIG. 12 is a side view of FIG. 11.

On the other hand, as shown in FIGS. 11 and 12, the variable bed 3 has a variable bedstead 30 constituting a bed surface. The variable bedstead 30 comprises a frame 31 and a mat 32 mounted on the frame 31. As shown in FIG. 2, a contour 30*a* (see FIG. 11) of the variable bedstead 30 is shaped to be tightly fitted in a notched recess portion 20*a* (see FIG. 6) formed between the left frame 21L and the right frame 21R, and rear frame 21B of the fixed bed 2.

Figure 13:
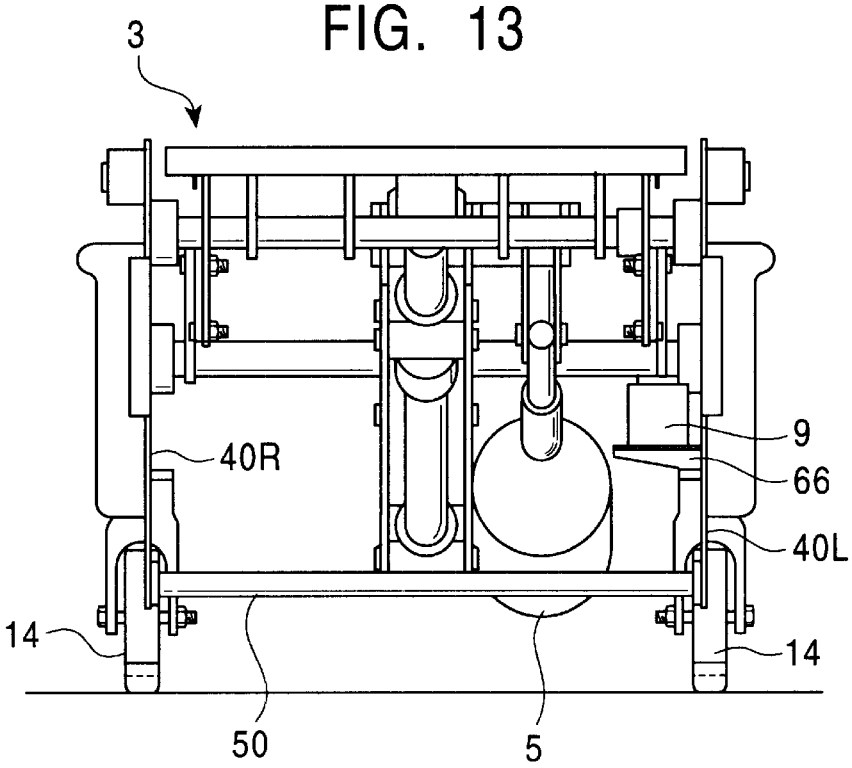
FIG. 13 is a front view of FIG. 11.
Figure 14:
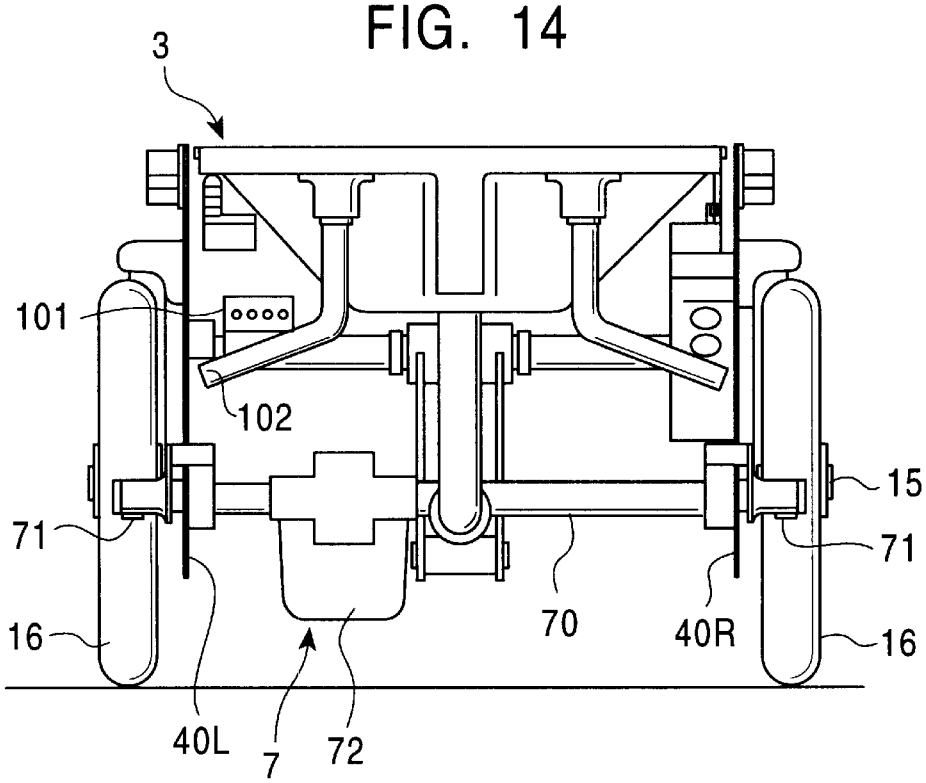
FIG. 14 is a rear view of FIG. 11.

As shown in FIGS. 12 to 14, the frame 31 of the variable bedstead 30 of the variable bed 3 has body frames 40L, 40R attached to a bottom surface thereof and acting as a wheelchair, described later. The body frames 40L, 40R have a pair of caster-type front wheels 14, 14 attached thereto to allow the advancing direction to be changed, and a pair of rear wheels 16, 16 also attached thereto and including an axle 15, and the variable bed is configured so as to run freely as a wheelchair.

Figure 15:
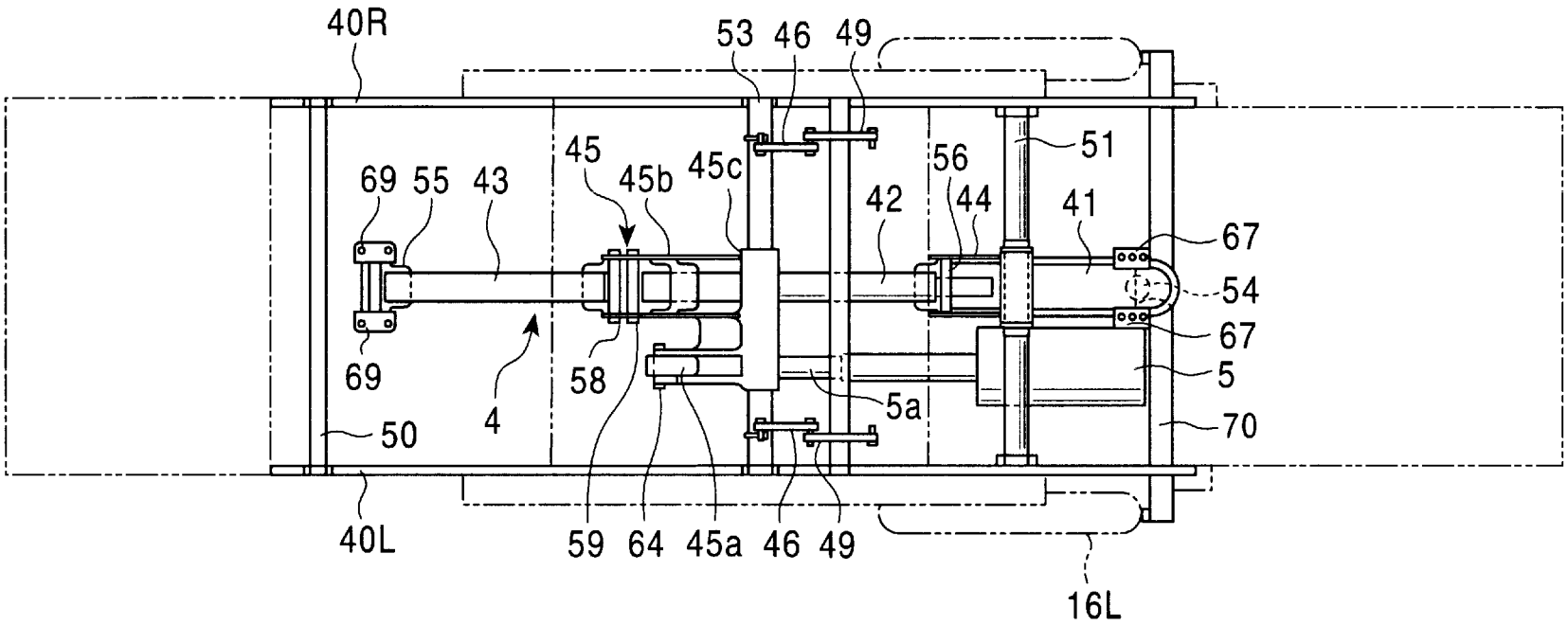
FIG. 15 is a top view showing the configuration of a link mechanism in the horizontal bed form of the variable bed.
Figure 16:
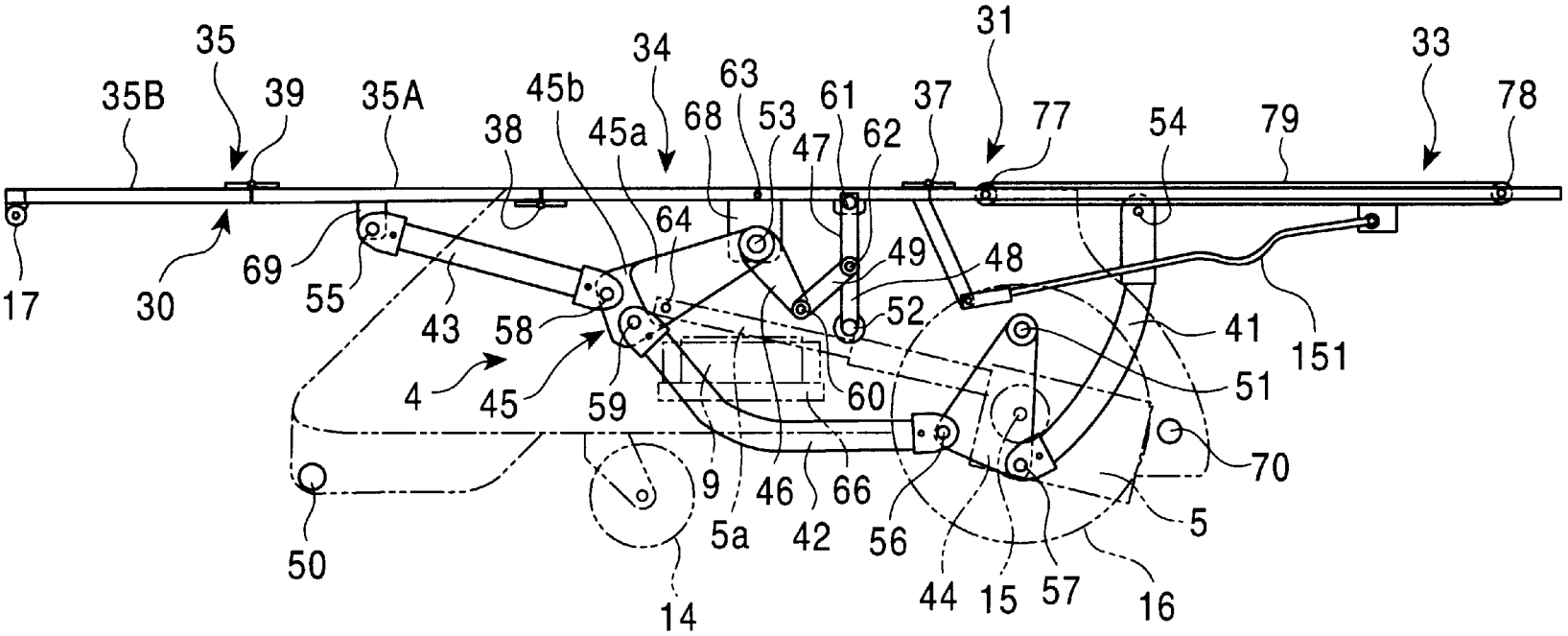
FIG. 16 is a side view of FIG. 15.
Figure 17:
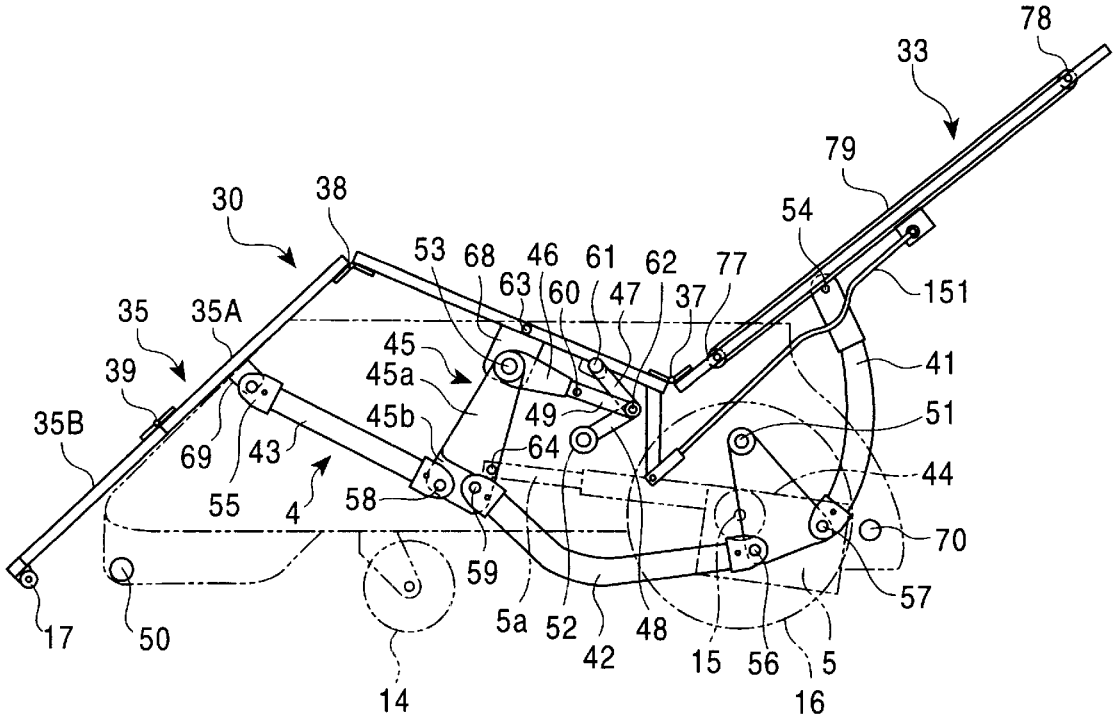
FIG. 17 is a side view showing the configuration of the link mechanism in a reclining form of the variable bed.
Figure 18:
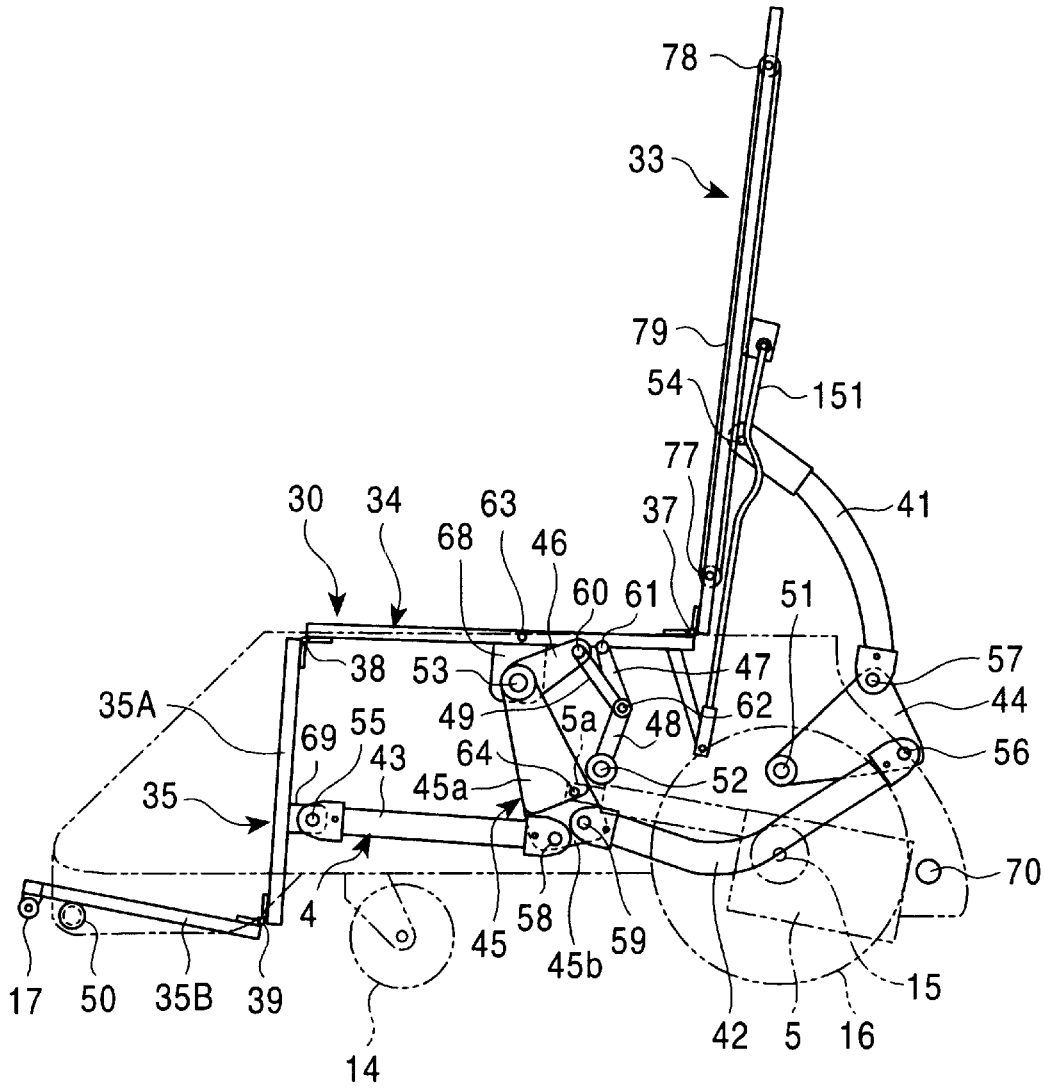
FIG. 18 is a side view showing the configuration of the link mechanism in the wheelchair form of the variable bed.
Figure 19:
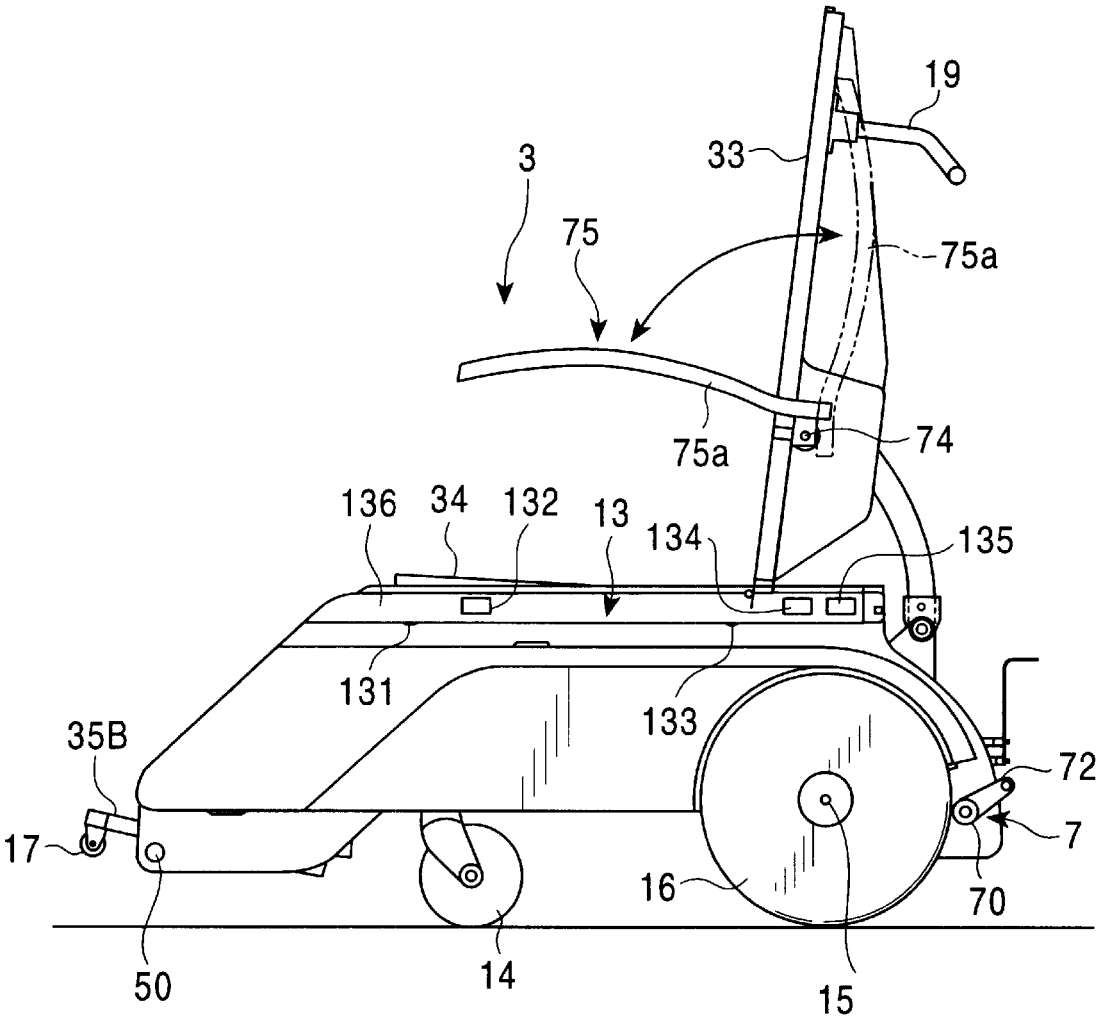
FIG. 19 is a side view showing the wheelchair form of the variable bed.

In the present invention, the variable bed 3 can be changed between three forms; that is, it can constitutes a part of a horizontal bed in the horizontal bed form as shown in FIGS. 12, 15 and 16, a reclining seat in a reclining seat form as shown in FIG. 17, or the wheelchair in the wheelchair form as shown in FIGS. 18 and 19, and is configured to function as the bed, the reclining seat, and the wheelchair.

Figure 3:
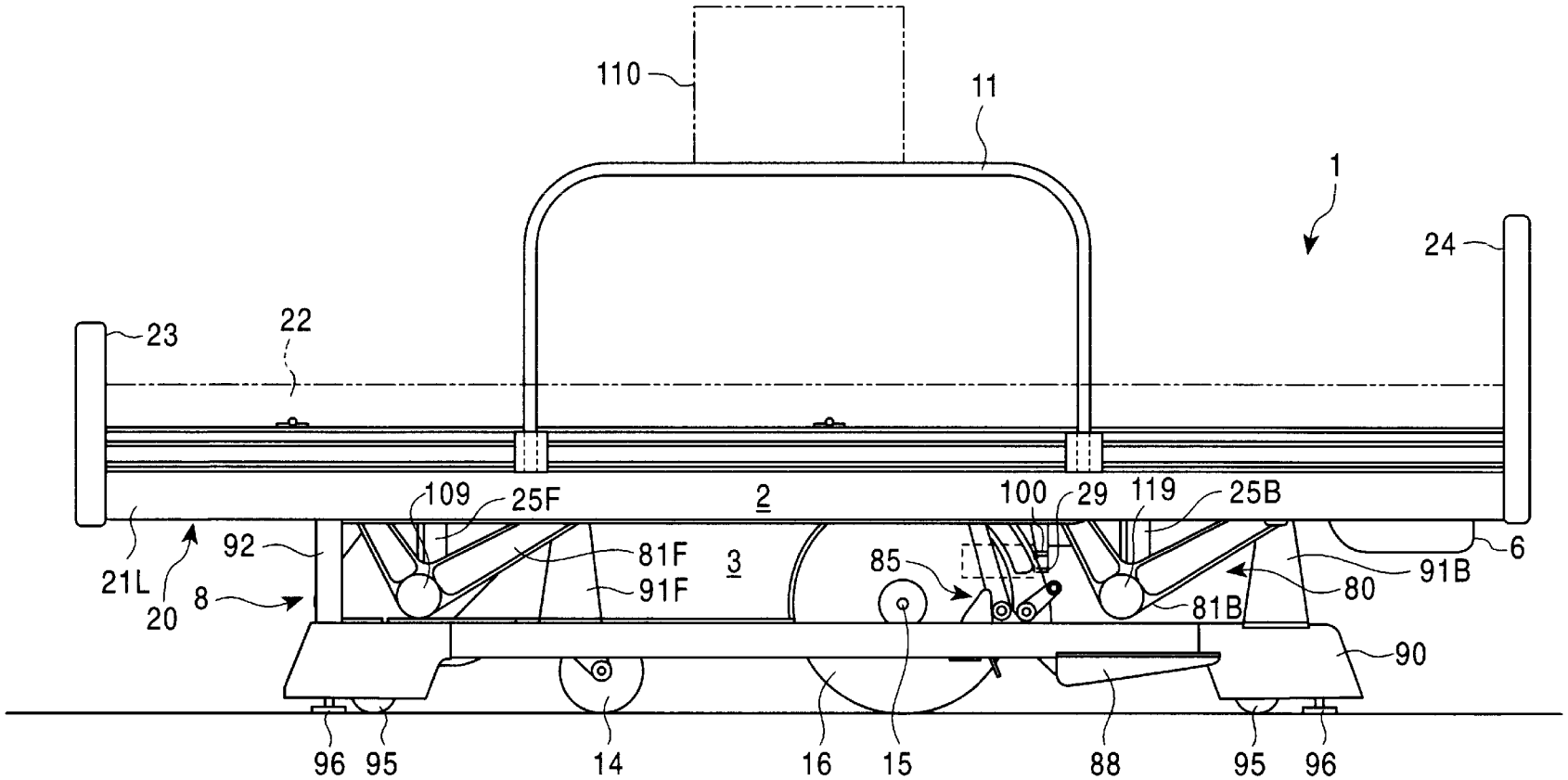
FIG. 3 is a side view of FIG. 1.
Figure 4:
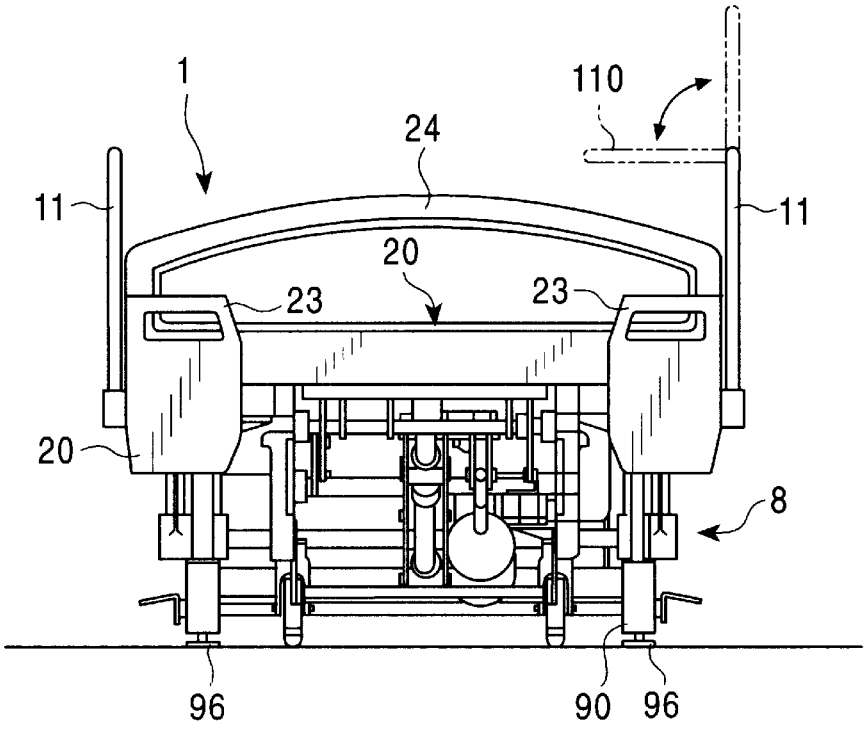
FIG. 4 is a front view of FIG. 1.
Figure 5:
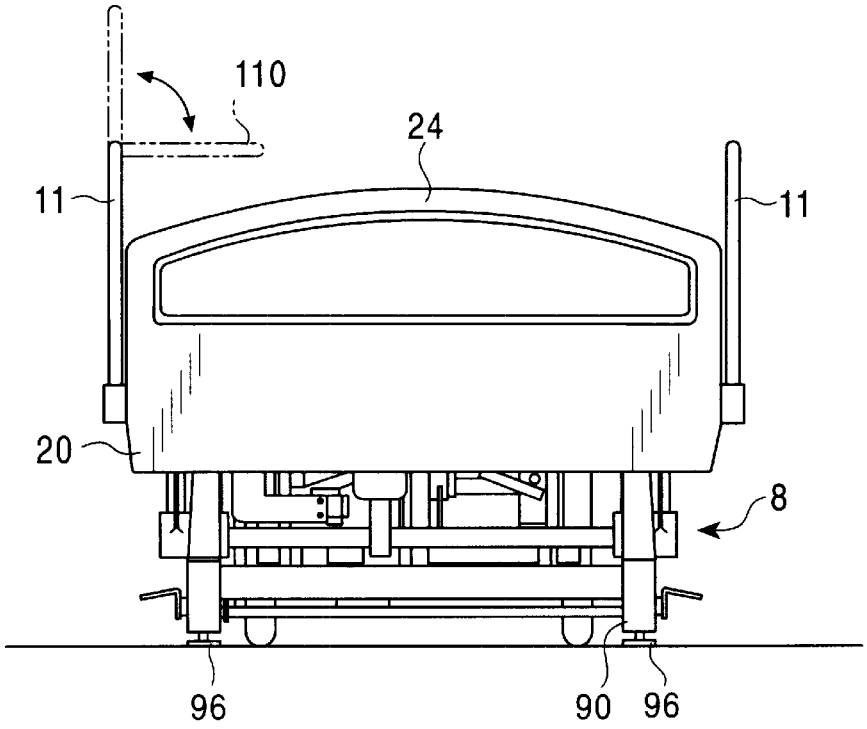
FIG. 5 is a rear view of FIG. 1.

As shown in FIGS. 2 and 3, the fixed bed 2 including the leg portion 8 and the variable bed 3 including the pair of front wheels 14, 14 and the pair of rear wheels 16, 16 via the body frames 40L, 40R are designed so that when they are combined into the horizontal bed form, a top surface of the mat 22 of the bedstead 20 of the fixed bed 2 and a top surface of the mat 32 of the variable bed 30 of the variable bed 3 are flush with each other in a manner such that the fixed bed 2 and the variable bed 3 integrally form a relatively wide bed surface.

The variable bed 3 is configured as shown below in order to function as the above three forms.

First, the variable bedstead 30 of the variable bed 3 is divided into a seat back portion 33, a seat portion 34 and a foot rest portion 35 constituting the wheelchair and connected together by joint-line connection members 37, 38 for free bending, as shown in FIGS. 15 to 18.

Furthermore, the foot rest portion 35 of the variable bed 3 is divided into a hanging portion 35A and a foot resting portion 35B connected to the hanging portion 35A via a joint-like connection member 39 for free bending.

An important point of the present configuration will be mentioned below. When the variable bed 3 is changed from the horizontal bed form to the wheelchair form via the reclining seat form, a person lying on the bed changes gradually to a seating portion in accordance with the form change. In this case, to prevent the person lying on the bed from being pushed out forward while the variable bed is being changed into the wheelchair form, the present bed is configured to change its form in a manner such that the seat portion 34 is inclined in accordance with the inclination of the seat back portion 33 so that a side of the seat portion 34 which is closer to the foot rest portion 35 is located above the opposite side, thus allowing the buttocks of the person lying on the bed to sink relative to the horizontal bed form.

Based on the above configuration, the present bed has a link mechanism 4 for individually linking the seat back portion 33, seat portion 34, and foot rest portion 35 of the variable bed 3 with the body frames 40L, 40R. The use of the link mechanism 4 enables the horizontal bed portion of the variable bed 3 to be deformed into the seat back portion 33, the seat portion 34, and the foot rest portion 35 constituting the wheelchair, using a single electric motor 5.

Power is supplied to the electric motor 5 mounted in the variable bed 3 as a drive source, by pushing and fitting the variable bed 3 in the notched recess portion 20*a* of the fixed bed 2 so as to couple a power supply receptacle 100 arranged in the fixed bed 2 to a plug 101 arranged in the variable bed 3 as shown in FIGS. 3 and 14.

Specifically, the receptacle 100 is disposed in front of a bracket 29 installed so as to extend perpendicularly from a rear portion of the left frame 21L of the fixed bed 2.

On the other hand, the plug 101 is aligned with the receptacle 100 and is fixedly installed on a stay 102 attached to the variable bed 3 inward of the left frame 40L as shown in FIG. 14.

The receptacle 100 has V-shaped guide sections 100*b* and 100*b* at both sides of an insertion port 100*a* thereof, for guiding the plug 101 so that it is reliably inserted into the receptacle 100 when the variable bed 3 and the fixed bed 3 are coupled together.

Next, the link mechanism 4 of the variable bed 3 will be explained.

As shown in FIGS. 13 to 16, a rotationally moving fulcrum shaft 51 is extended between the left and right body frames 40L, 40R above the axle 15, and a rotationally moving fulcrum shaft 52 is installed between the front and rear wheels 14, 16 at the same height as the rotationally moving fulcrum shaft 51. Further, a fixed shaft 50 and a rotationally moving fulcrum shaft 70 are installed at lower front- and rear-end positions, respectively, of the body frames 40L and 40R.

A left and a right side surfaces of the seat portion 34 and the left body frame 40L and right body frame 40R are pivoted at pivoting points 63, 63 located substantially in the center of the seat portion 34 in its longitudinal direction, and brackets 68, 68 are installed so as to hang down from the locations of the pivoting points 63, 63 so that the rotationally moving fulcrum shaft 53 is journaled between the brackets 68, 68. Pivoting points 61, 61 are provided on both side surfaces of the seat portion 34 behind the brackets 68, 68 so that upper ends of arm pieces 47, 47 can be pivotably connected to the pivoting points 61, 61.

Lower ends of arm pieces 48, 48 are pivotably connected to a left and a right ends of the rotationally moving fulcrum shaft 52, and lower ends of the arm pieces 47, 47, upper ends of the arm pieces 48, 48, and rear ends of the arm pieces 49, 49 are pivotably connected together at the pivoting points 62, 62.

Further, brackets 67, 67 are installed on a back surface of the seat back portion 33, 33 so as to hang from the lateral center of a front portion thereof so that a pivoting shaft 55 can be supported between the brackets 67, 67.

Furthermore, brackets 69, 69 are installed so as to hang from the neighborhood of the lateral center of the hanging portion 35A of the foot rest portion 35 so that a pivoting shaft 55 can be supported between the brackets 69, 69.

The neighborhood of the apex angle of an isosceles-triangle-shaped rotationally moving member 44 is attached to the lateral center of the rotationally moving fulcrum shaft 51, and pivoting points 56, 57 are disposed near the base angles of the rotationally moving member 44 in a manner such that the pivoting point 56 is located in front of the pivoting point 57.

Further, the rotationally moving fulcrum shaft 53 has a rotationally moving member 45 attached thereto. The rotationally moving member 45 comprises two substantially-isosceles-triangle-shaped members 45*a*, 45*b* installed in parallel and fixedly connected together in the neighborhood of the apex angles thereof by means of a cylindrical portion 45*c* in such a manner as to appear U-shaped as seen in a top view. The left-hand member 45*a* is hereafter referred to as a "main rotationally moving portion", and the right-hand member 45*b* is hereafter referred to as a "dependent rotationally moving portion". A rotationally moving fulcrum shaft 53 is rotatably fitted in the cylindrical portion 45*c* with the dependent rotationally moving portion 45*b* arranged in the lateral center thereof.

Further, pivoting points 58, 59 are disposed near the base angles of the dependent rotationally moving portion 45*b* in a manner such that the pivoting point 58 is located in front of the pivoting point 59. On the other hand, the main rotationally moving portion 54*a* has a pivoting point 64 disposed near the rearward base angle.

Rotationally moving pieces 46, 46 are attached to a left and a right ends of the rotationally moving fulcrum shaft 53 so as to extend rearward and downward, and rear ends of the rotationally moving pieces 46, 46 and front ends of the arm pieces 49, 49 are pivotably connected together at pivoting points 60, 60.

Moreover, the pivoting shaft 54 of the seat back portion 33 of the variable bed 3 and the pivoting point 57 of the rotationally moving member 44 are pivotably connected together by means of a link bar 41, and the pivoting point 56 of the rotationally moving member 44 and the pivoting point 59 of the dependent rotationally moving portion 45*b* of the rotationally moving member 45 are pivotably connected together by means of a link bar 42. The pivoting point 58 of the dependent rotationally moving portion 45*b* and the pivoting shaft 55 of the hanging portion 35A of the foot rest portion 35 of the variable bed 3 are pivotably connected together by means of a link bar 43.

The link bars 41, 42 are bent like bows, while the link bar 43 is shaped like a rod.

Figure 1B:
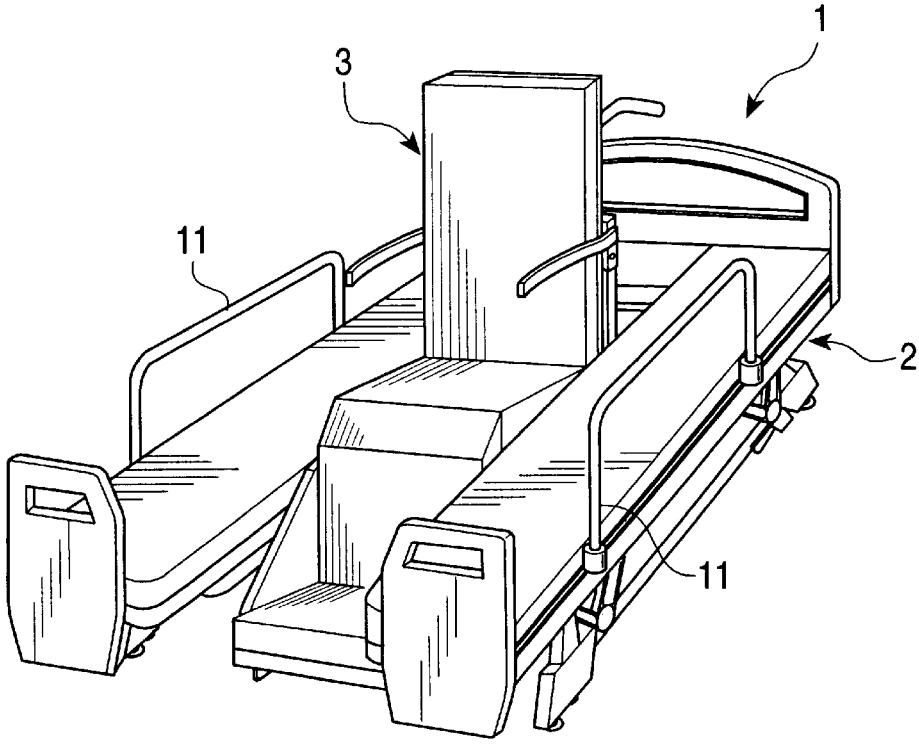
FIG. 1B is a perspective view of the entire multifunctional bed in which the variable bed (a wheelchair form) is fitted in the fixed bed.

Supporting wheels 17 are installed at a front end of the foot placing portion 30B of the variable bedstead 30 so as to hang therefrom so that when the variable bed 3 is in the reclining form as shown in FIG. 17 or in the wheelchair form as shown in FIG. 1, or is in transition to either form, the supporting wheels 17 come into contact with the ground to prevent the variable bed from overturning frontward.

As shown in FIG. 15, the electric motor 5 is disposed inwardly sideward of the left rear wheel 16L to effect driving so as to slidably displace a motor rod 5*a* in a longitudinal direction. Further, the front end of the motor rod 5*a* is pivotably connected to the pivoting point 64 of the main rotationally moving portion 45*a* of the rotationally moving member 45.

With the link mechanism 4, if the variable bed 3 is changed from the horizontal bed form shown in FIG. 16 to the wheelchair form shown in FIG. 18 via the reclining seat form shown in FIG. 17, the electric motor 5 is switched on to rotate forward so that the motor rod 5*a* is housed in the electric motor 5 and slidably displaced rearward. As s result, as shown in the side view in FIG. 17, the rotationally moving member 46 and the rotationally moving piece 46 rotate around the rotationally moving fulcrum shaft 53 counterclockwise. Further, the rotation of the rotationally moving piece 46 raises a front end of the arm piece 49 and displaces the arm piece 49 rearward while rotating it clockwise, thereby pushing up the pivoting point 62.

At this time, the arm piece 48 rotates clockwise around the rotationally moving fulcrum shaft 52, while the arm piece 47 has its lower end pushed up and is displaced rearward and downward while rotating counterclockwise. Accordingly, the pivoting point 61 is pulled rearward and downward to rotationally move the seat portion 34 of the variable bed 3 clockwise around the pivoting point 63, 63, thus sinking the seat back portion-connected side of the seat portion 34, while elevating the foot rest portion-connected side of the seat portion 34.

At the same time, the rotationally moving member 45 rotates, so that the dependent rotationally moving portion 45*b* of the rotationally moving member 45 pulls the link bar 43 rearward and downward, while pushing the link bar 42 rearward and downward.

As a result, the foot rest portion 35 is pulled rearward and downward via the link bar 43, while the seat portion 34 is rotationally moved as described previously to warp the seat portion 34 and the foot rest portion 35 together via the joint-like connection means 38 to thereby elevate the seat portion-connected side of the foot rest portion 35, while sinking a front end of the foot rest portion 35. On the other hand, the rotationally moving member 44 is rotated counterclockwise around the rotationally moving fulcrum shaft 51 via the link bar 42, thus pushing up the link bar 41. Thus, the seat back portion 33 is pushed via the link bar 41 so as to move around the joint-like connection means 37 in a direction in which it is stood up.

Furthermore, if the electric motor 5 is activated to change the present bed from the reclining seat form shown in FIG. 17 to the wheelchair form shown in FIG. 18, the seat back portion 33 and foot rest portion 35 of the variable bed 3 are displaced counterclockwise as described previously.

At this time, the back surface of the front portion of the foot placing portion 35B of the foot rest portion 35 comes in abutment with the fixed shaft 50 at the front end of the main body. Then, the foot rest portion 35 rotationally moves to bend the hanging portion 35A and the foot placing portion 35B via the connection means 39, so that the foot placing portion 35B is placed in a substantially horizontal position, while the hanging portion 35A is placed in a vertical position. Thus, the deformation is completed.

In this stage, for the seat portion 34 of the variable bed 3, the rotationally moving piece 46 rotationally moves beyond the horizontal position and further frontward and upward, thereby pulling the pivoting fulcrum 62 frontward via the arm piece 49. Consequently, the arm pieces 47, 48 are displaced in a direction opposite to the displacement direction mentioned preciously and are thus changed from a state in which they are bent in such a manner as to appear V-shaped to a state in which they are extended substantially linearly, thus displacing the seat portion 34 again to a substantially horizontal position.

The wheelchair form shown in FIG. 18 is changed into the horizontal bed form shown in FIG. 16 using a procedure reverse to the one described previously, that is, by reversely rotating the electric motor 5 so that the motor rod 5*a* can be extended out from the electric motor 5 and slidably displaced forward. While the variable bed 3 is fitted in the fixed bed 2 and returned to its original horizontal position, the user sitting in the wheelchair is automatically laid, that is, returns to the user's original position.

As shown in FIG. 16, a stay 66 is attached to the left frame 40L of the variable bed 3 in front of the electric motor 5 and a battery 9 is fixedly placed on the stay 66. Accordingly, even when the fixed bed 2 and the variable bed 3 are separated from each other, the battery 9 can supply power to enable the variable bed 3 to change its position a number of times.

Next, a roller belt 79 disposed on the seat back portion 33 of the variable bed 3 will be described.

Normally, when the variable bed 3 with the patient lying therein is changed from the horizontal bed form to the wheelchair form or vice versa, since the rotationally moving fulcrum position of the seat back portion 33 is offset from the bending fulcrum position of the patient's waist, the patient's back rubs against the seat back portion 33 in connection with the vertical rotational movement of the seat back portion 33, thus making the patient feel uncomfortable.

Thus, the roller belt 79 is disposed on the seat back portion 33 to solve this problem as described below.

That is, rollers 77, 78 are disposed in the lateral center of a front and rear portions, respectively, of the seat back portion 33 of the variable bed 3, and a roller belt 79 is wound between the rollers 77, 78, as shown in FIGS. 16 and 17.

A back side of the roller belt 79 is connected to the seat portion 34 by means of a link rod 151 so that a front side of the roller belt 79 moves in the longitudinal direction in connection with the vertical rotational movement of the seat back portion 33.

That is, if the seat back portion 33 rotationally moves upward, the front side of the roller belt 79 moves rearward in a fashion following the patient's back. Additionally, if the seat back portion 33 rotationally moves downward, the front side of the roller belt 79 moves frontward in a fashion following the patient's back. Consequently, the patient's back is prevented from rubbing against the seat back portion 33.

Next, armrests attached to the variable bed 3 will be explained.

Figure 20:
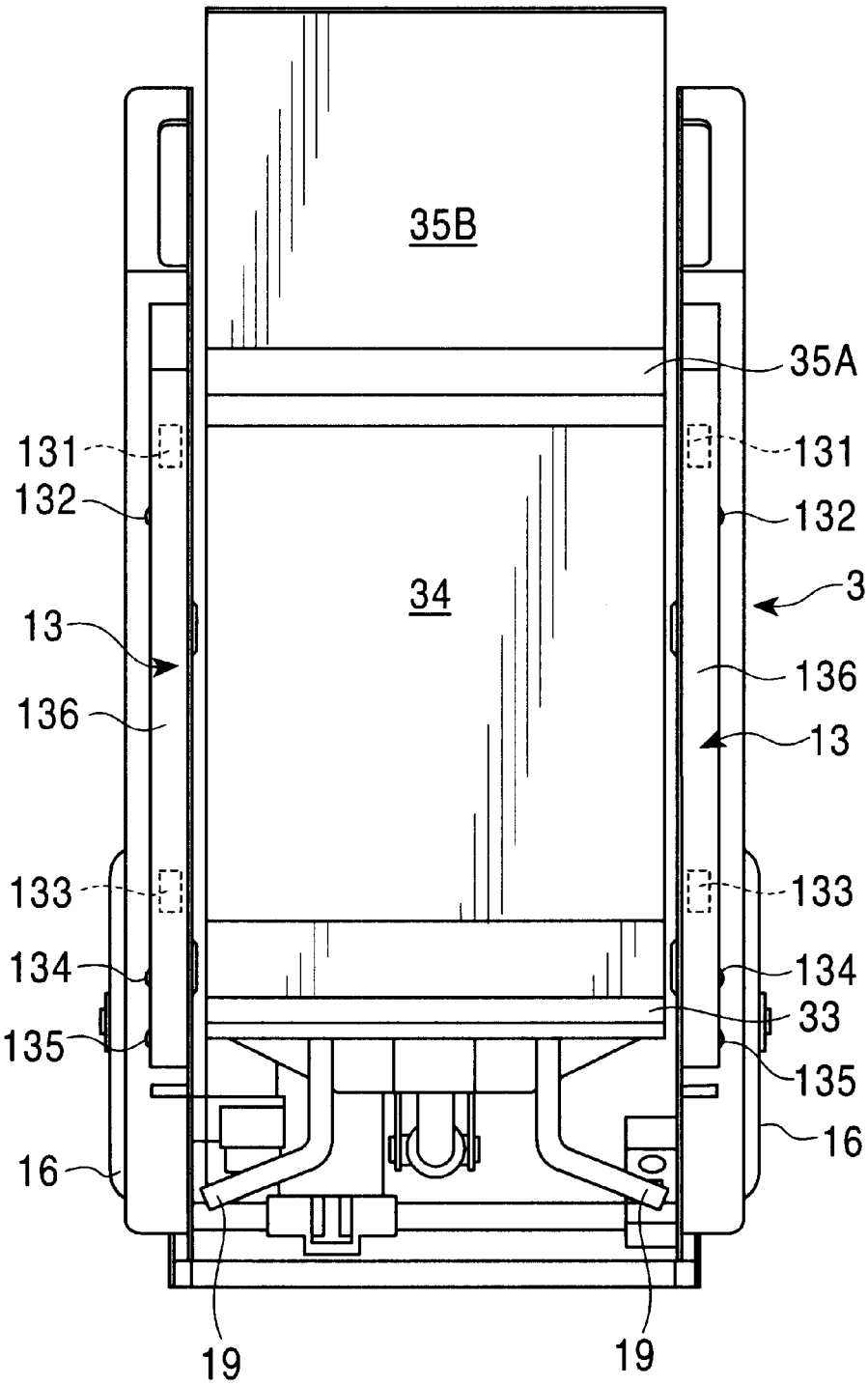
FIG. 20 is a top view of FIG. 19.

As shown in FIGS. 19 and 20, a lateral pair of handles 19, 19 are installed on an upper part of the back surface of the seat back portion 33 so as to project therefrom, and armrest members 75, 75 are disposed at both sides of the seat back portion 33. The armrest members 75, 75 are normally housed on the back surface of the seat back portion 33 of the variable bed 3 and are configured so as to be brought down forward when the variable bed 3 is changed into the wheelchair form.

The armrest member 75 comprises an armrest portion 75*a* and a supporting shaft portion 75*b* which are configured so as to appear L-shaped. On the back surface of the seat back portion 33, a lateral pair of cylindrical members 76, 76 are installed in a lower part of the seat back portion 33 so as to extend in the lateral direction. Then, the supporting shaft portion 75*b* of the armrest member 75 is fittingly inserted into the cylindrical member 76, and the armrest members 75, 75 are slid laterally outward. When the armrest members 75, 75 pass beyond both end surfaces of the seat back portion 33, they are brought down forward and then set.

Stoppers 74, 74 are installed so as to project from both side surfaces of the seat back portion 33, and an outer side surface of the stopper 74 regulates the sliding of the armrest member 75 and its top surface regulates the rotational movement of the armrest member 75.

Next, a brake mechanism of the variable bed 3 will be explained.

Figure 21:
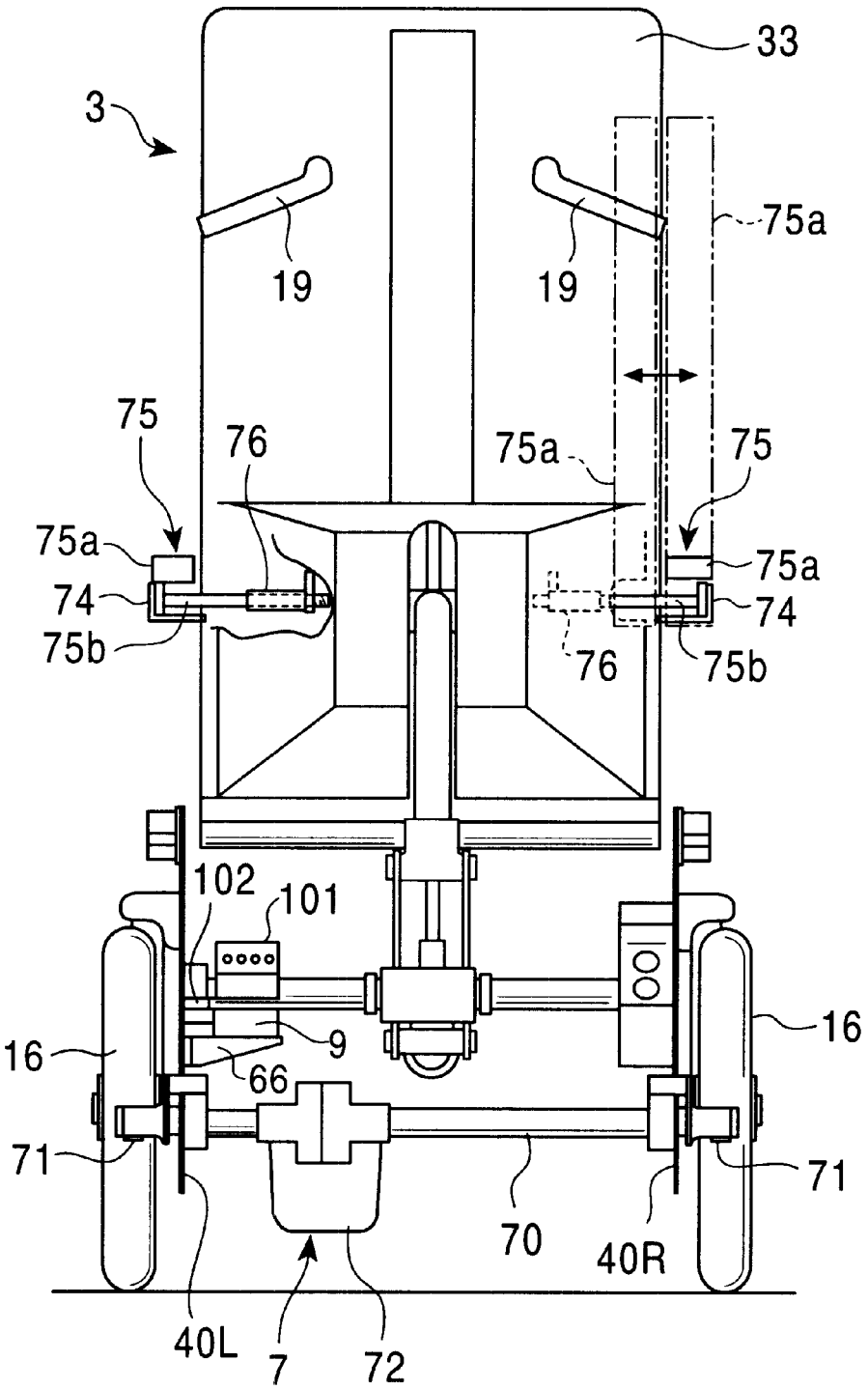
FIG. 21 is a rear view of FIG. 19.

As shown in FIGS. 19, 20, and 21, the rotationally moving fulcrum shaft 70 in the rear portion of the main body has claw portions 71, 71 installed at both ends thereof so as to project frontward and downward, and a step 72 is installed laterally halfway between the claw portions so as to project rearward and upward. The rotationally moving fulcrum shaft 70, the claw portions 71, 71, and the step 72 constitute a foot brake 7.

Figure 22:
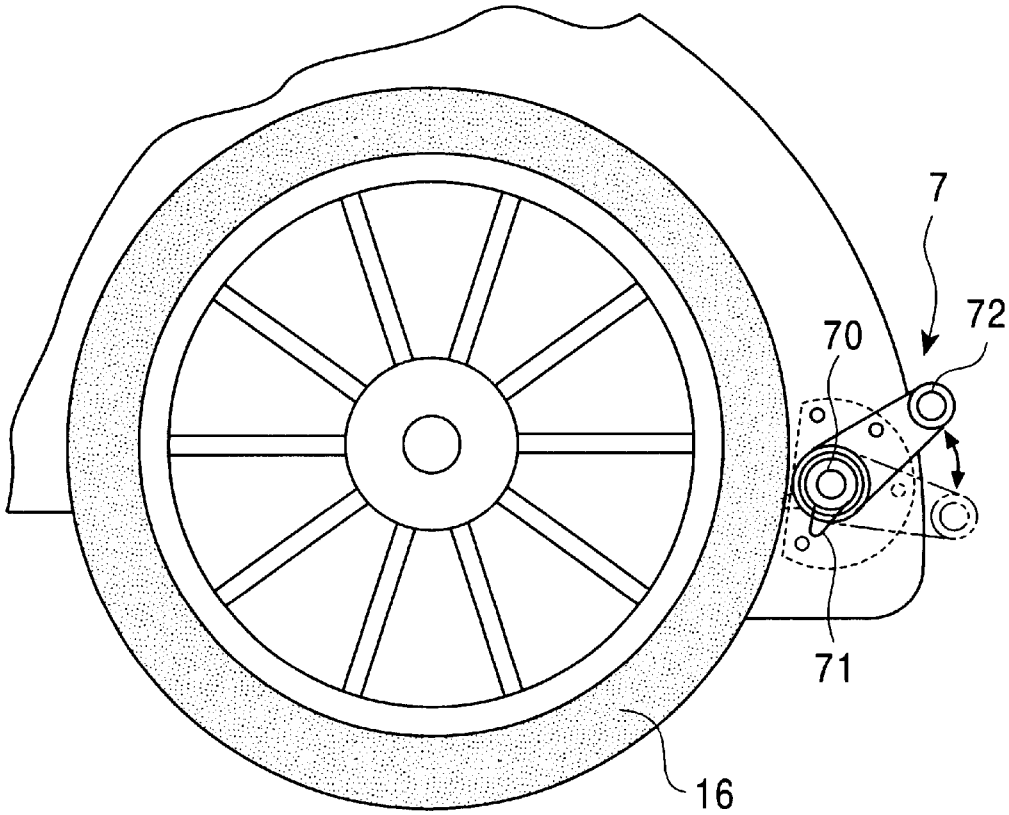
FIG. 22 is a side view showing the configuration of a brake mechanism of the variable bed.

With this configuration, when the caregiver steps on the step 72 of the foot brake 7, the rotationally moving fulcrum shaft 70 is rotated clockwise as seen in a side view and the claw portions 71, 71 located at both ends of the rotationally moving fulcrum shaft 70 is also rotated in the same direction, as shown in FIG. 22. Thus, the claw portions 71, 71 come is pressure contact with the rear wheels 16 and 16 to brake them.

Next, the link mechanism 80 associated with the elevation and lowering of the fixed bed 2 will be explained.

Figure 7:
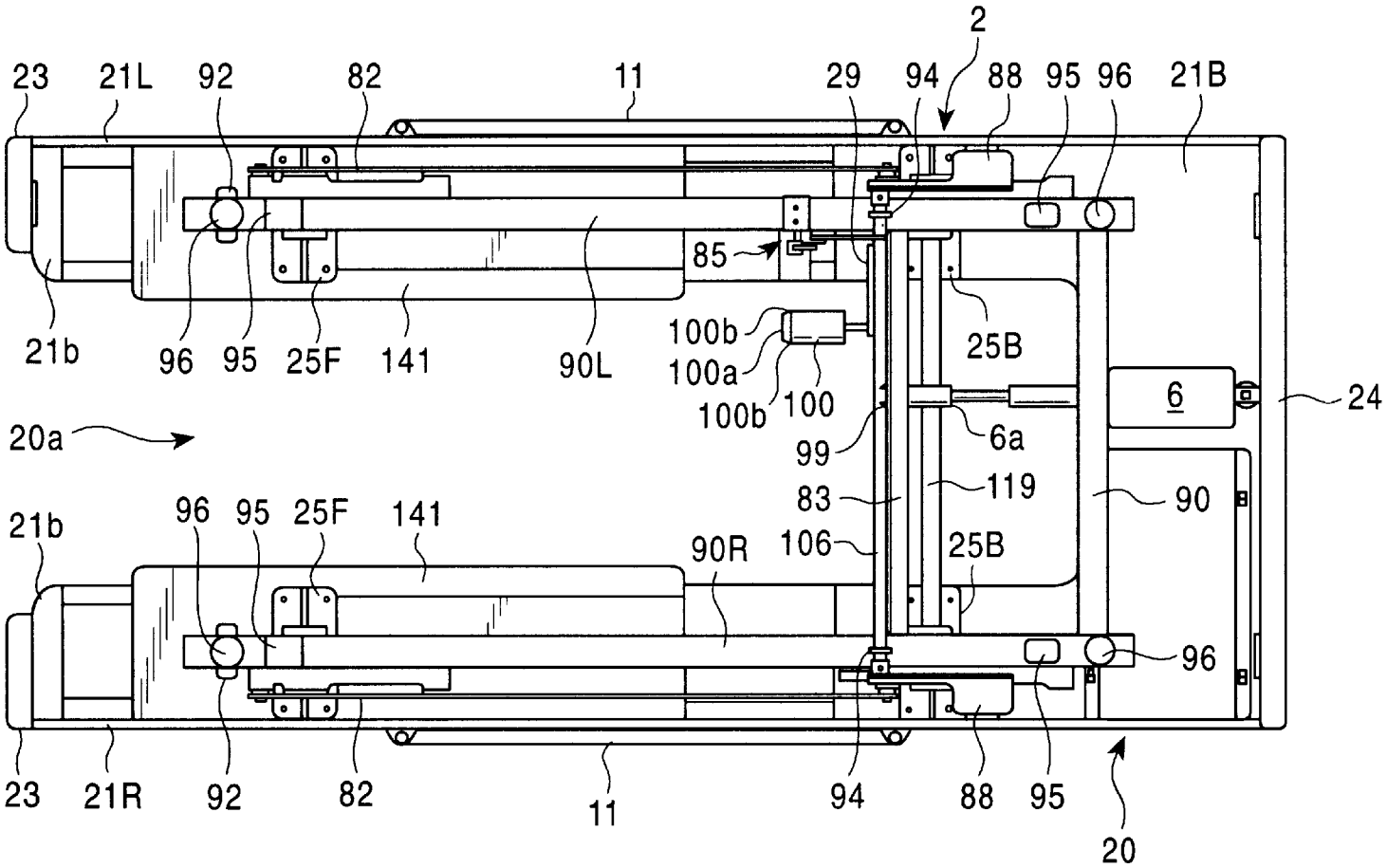
FIG. 7 is a bottom view of FIG. 6.
Figure 8A:
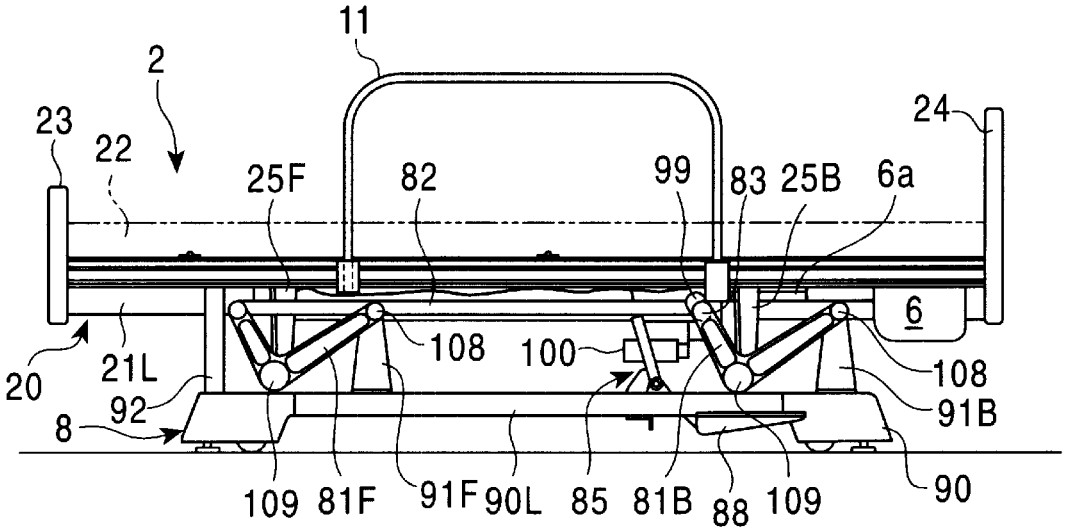
FIG. 8A is a side view showing that the fixed is lowered.
Figure 8B:
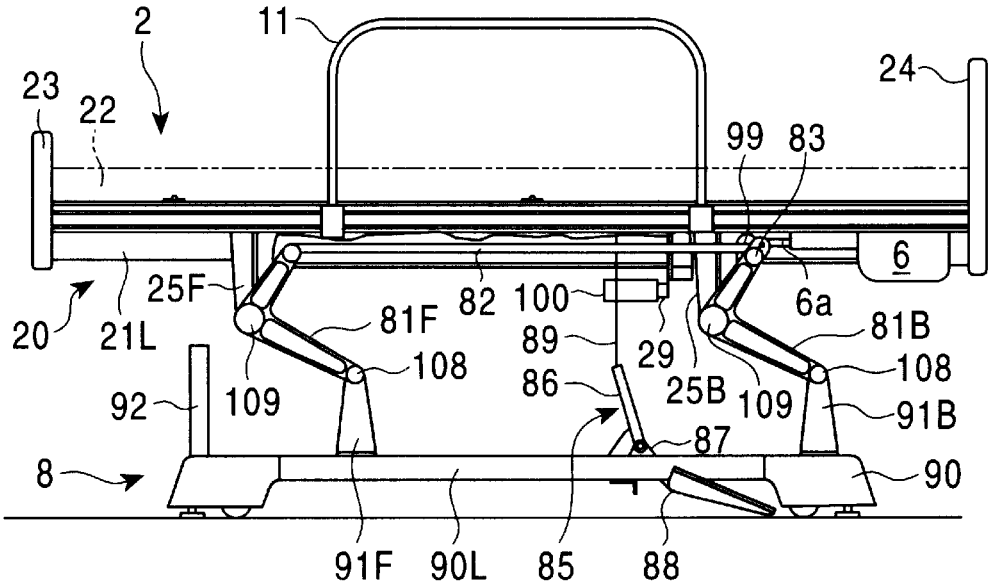
FIG. 8B is a side view showing that the fixed bed is elevated.

As shown in FIGS. 7 and 8, the leg portion 8 of the fixed bed 2 comprises the members constituting the link mechanism 80, the leg stand 90, and other components.

Leg base portions 91F, 91F and 91B, 91B are installed at a left and a right positions in a front and a rear portions of the leg stand 90 so as to stand up therefrom, and bed supporting members 25F, 25F and 25B, 25B are installed at a left and a right positions in a front and a rear portions of the bed 20 so as to extend perpendicularly therefrom. The leg base portions 91, 91F and 91B, 91B are connected to the opposite bed supporting members 25F, 25F and 25B, 25B by means of arm members 81F, 81F and 81B, 81B appearing L-shaped as seen in a side view. 108, 108 . . . are pivoting fulcrums for pivotably connecting an upper end of the leg base portion 91F (91B) to a tip portion of the arm member 81F (81B), and 109, 109 are pivoting fulcrums for pivotably connecting a lower end of the bed supporting member 25F (25B) to a bent portion of the arm member 81F (81B).

Further, the other end of the front arm member 81F is fixedly connected to the other end of the rear arm member 81B by means of a lateral pair of connection rods 82, 82, and the other ends of the rear arm members 81B, 81B are fixedly connected together by means of a connection rod 83. The connection rods 82, 83 and 82 are assembled together so as to appear U-shaped as seen in a top view. An electric motor 6 is installed in the lateral center of a bottom surface of the rear frame 21B of the bedstead 20 so as to hang therefrom, and a motor rod 6*a* is extended out from a front surface of the electric motor 6. A laterally intermediate portion of the connection rod 83 and a front end of the motor rod 6*a* are connected together by means of a connection member 99.

Then, stoppers 92, 92 are installed at both ends of a front end of the leg stand 90 so as to stand up therefrom, and a stopper mechanism 85 is disposed in a rear portion of the left frame 90L constituting the leg stand 90. The stopper members 92, 92 are fixed to the leg stand 90, and the stopper mechanism 85 comprises links.

The structure of the stopper mechanism 85 will be explained.

Figure 10A:
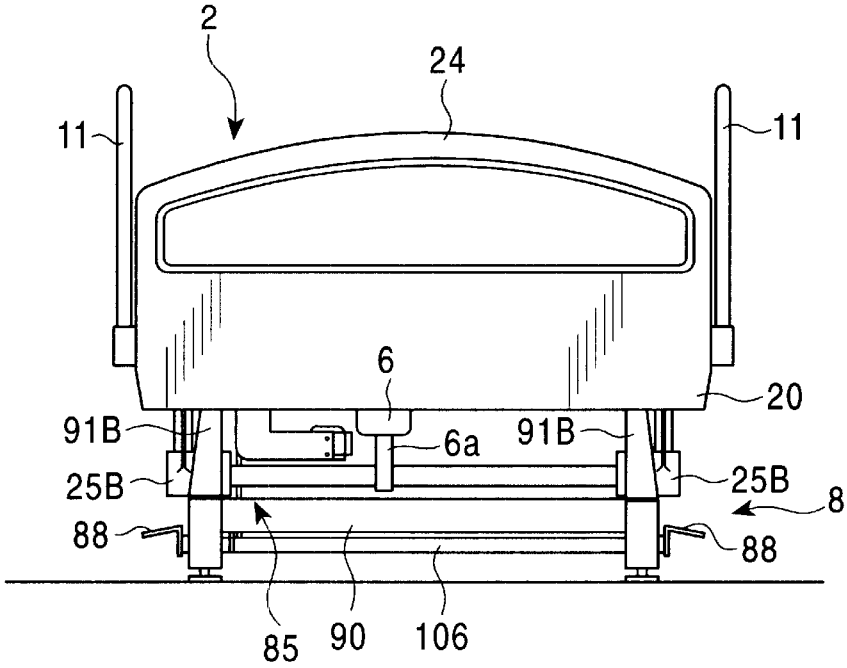
FIG. 10A is a rear view showing that the fixed bed is elevated.
Figure 23:
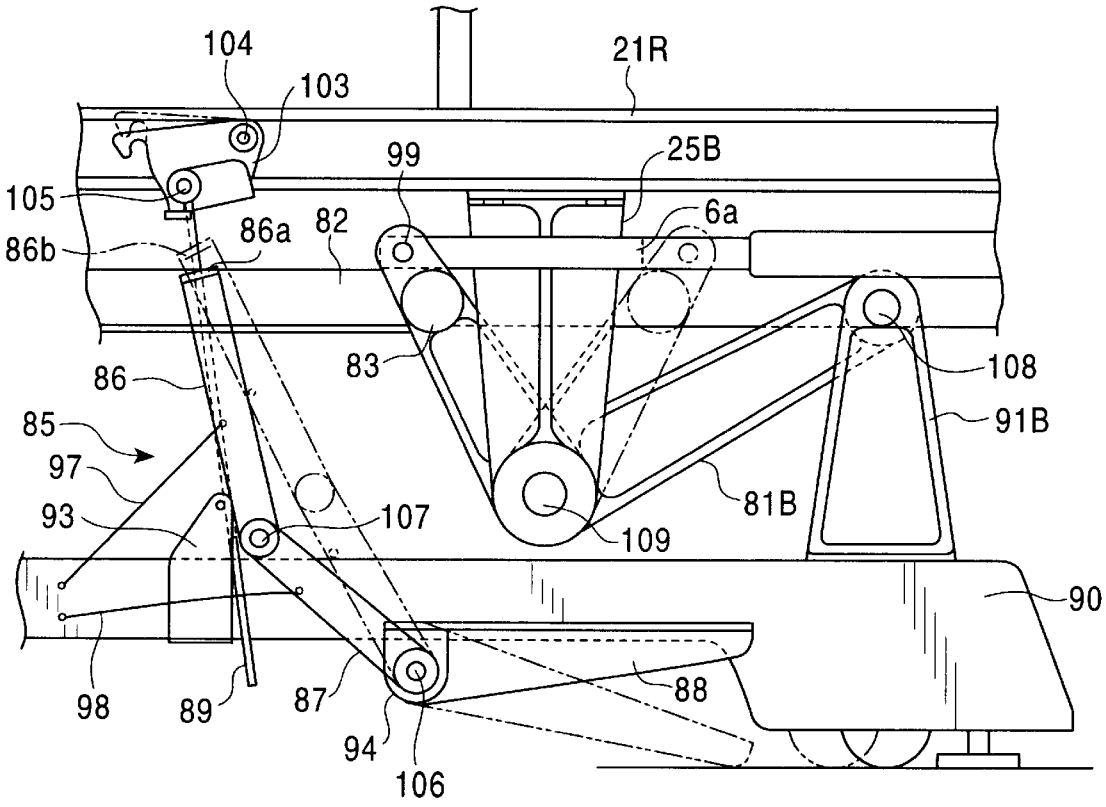
FIG. 23 is a side view showing the configuration of a stopper mechanism associated with the elevation and lowering of the variable bed.

As shown in FIGS. 8, 10 and 23, the stopper mechanism 85 comprises an upper link 86, a lower link 87 and a step 88. Further, the left frame 90L of the leg stand 90 has a block piece 93 installed in a rear portion thereof so as to project from a top surface thereof and a bracket 94 installed also in the rear portion so as to hang from a bottom surface thereof. At this time, the block piece 93 is arranged slightly ahead of the bracket 4, and the bracket 94 is also arranged on the right frame of the leg stand 90 in a manner such that the two brackets 94 are laterally symmetrical.

Further, the lower link 87 and the step 88 are fixedly connected together via the connection rod 106 so as to appear V-shaped as seen in a side view, and a lower end of the upper link 86 and an upper end of the lower link 87 are pivotably connected together at a pivoting point 107.

A pivoting point 104 is provided above the block piece 93 and on an inner surface of the left frame 21L of the bedstead 20, and a rotationally moving piece 103 is pivotably connected to the pivoting point 104. A supporting point 105 is provided in a lower part of the rotationally moving piece 103, and the rod 89 is hung from the supporting point 105.

Figure 10B:
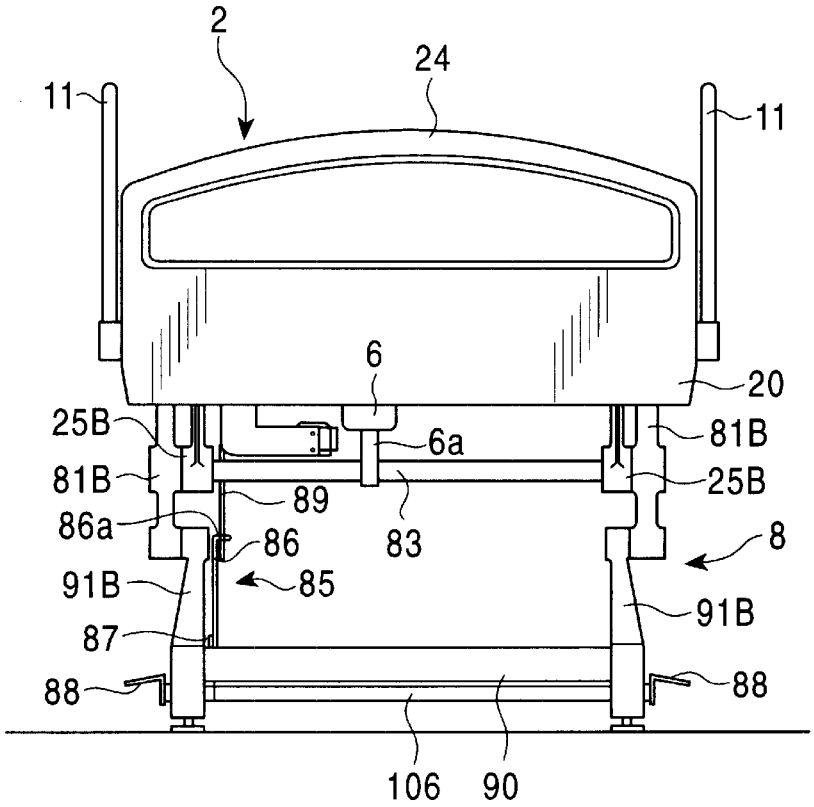
FIG. 10B is a side view showing that the fixed bed is elevated.

As shown in FIG. 10B, the upper link 86 appear inverted-L-shaped as seen in a front view (a rear view) and has a central portion of its top surface 86*a* drilled so that the rod 89 penetrates this drilled hole 86*b*.

Then, as shown in FIG. 23, a vertical central portion of the upper link 86 and a vertical central portion of the lower link 87 are urged by springs 67 and 68 by connecting them via these springs to a position of an inner side surface of the leg stand 90 which lies behind the block piece 93.

With this configuration, when the electric motor 6 is switched on to rotate forward, the motor rod 6*a* is housed in the electric motor 6 while being slidably displaced rearward. Further, the motor rod 6*a* pulls the connection rods 83, 82 and 82 rearward. In a side view shown in FIG. 8, the arm members 81F and 81B are hung from the connection rod 82 while being rotationally moved clockwise around the pivoting point 109, and the arm members 81F, 81B are stood up to elevate the bedstead 20. The upper limit on the elevation of the bedstead 20 is set by the stopper mechanism 85, described later.

Conversely, the electric motor 6 is reversely rotated so that the motor rod 6*a* is extended out from the motor 6 and slidably displaced forward, that is, operations reverse to those described previously are preformed to lower the bedstead 20. Further, when the bedstead 20 lowers, the bottom surface of the bedstead 20 comes in abutment with top surfaces of the stopper members 92, 92, and the lower limit on the lowering of the bedstead 20 is set by the stopper mechanism 85.

Next, how the stopper mechanism 85 regulates the elevation and lowering of the bedstead 20 will be explained.

First, how the stopper mechanism 85 regulates the elevation of the bedstead 20 will be explained. The rod 89 extending perpendicularly from the bottom surface of the bedstead 20 comes into abutment with a rear side of an inner peripheral surface of the cylinder of the upper link 86 urged by a spring 97, and a top surface of a rotationally moving piece 84 from which the rod 89 hangs comes in abutment with the bottom surface of the left frame 21L to regulate the rotation of the rotationally moving piece 84. Thus, the rod 89 is elevated directly above while maintaining its position with respect to the rotationally moving piece 84, thereby causing the upper link 86 to rotationally move counterclockwise while standing up. Then, when the upper link 86 and the lower link 87 are aligned in a line, the rod 89 further elevates and stands the upper link 86 up, while the rotational movement between the upper link 86 and the lower link 87 is stopped. The rod 89 is supported by the drilled hole 86*b* of the upper-link top surface 86*a* to limit the elevation of bed 20.

Further, when the bedstead 20 lowers, the upper link 86 and the lower link 87 are pulled by the springs 97, 98, respectively, and the rod 89 is lowered while being guided along an inner peripheral surface of the upper link 86, so that the upper link 86 and the lower link 87 rotationally move while inclining forward. The upper link 87 and the step 88 rotationally move counterclockwise around the connection rod 106 as seen in a side view, so that a connection portion between the upper link 86 and the lower link 87 comes in abutment with a rear surface of the block piece 93. Thus, the rotational movement of the stopper mechanism 85 is regulated, and the rod 89 is supported by the drilled hole 86*b* in the top surface 86*a* of the upper link 86 to limit the lowering of the bedstead 20.

Then, the steps 88, 88 are stepped on to forcibly rotationally move the upper link 86 and the lower link 87 to thereby clear the regulation of the rotational movement effected by the stopper mechanism 85.

Figure 9:
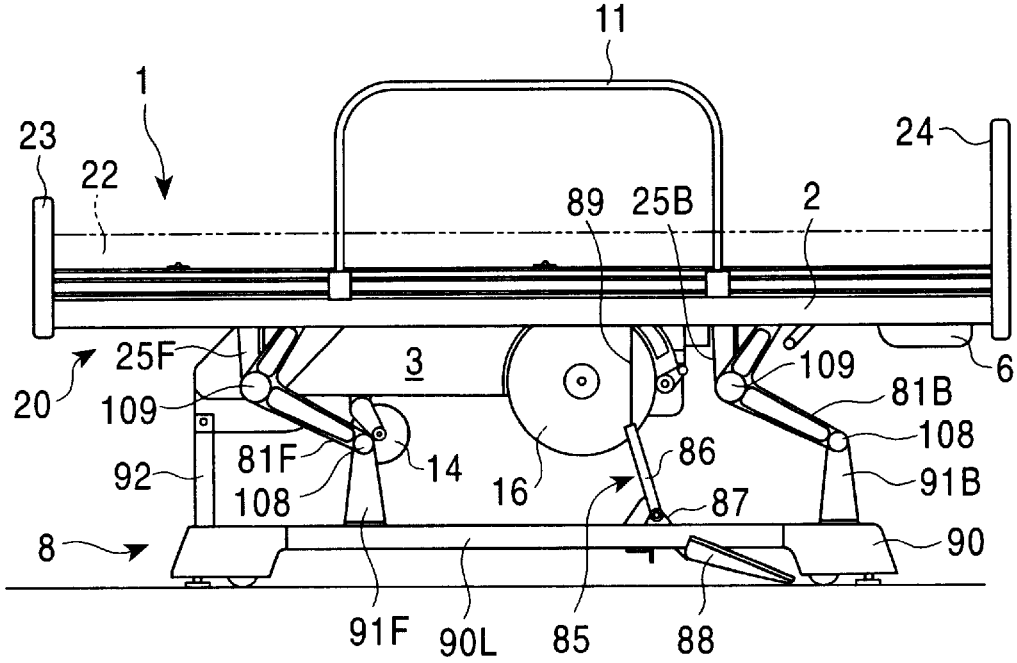
FIG. 9 is a side view showing that the fixed bed with the variable bed mounted thereon is elevated.

In this connection, the electric motor 6 for the fixed bed 2 has a large capacity enough to support the total weight and to elevate and lower the bed even when the fixed bed 2 and the variable bed 3 are integrated together and when the patient further lies thereon, as shown in FIG. 9.

Next, the handrails 11 attached to the fixed bed 2 according to the present invention will be explained.

Figure 24:
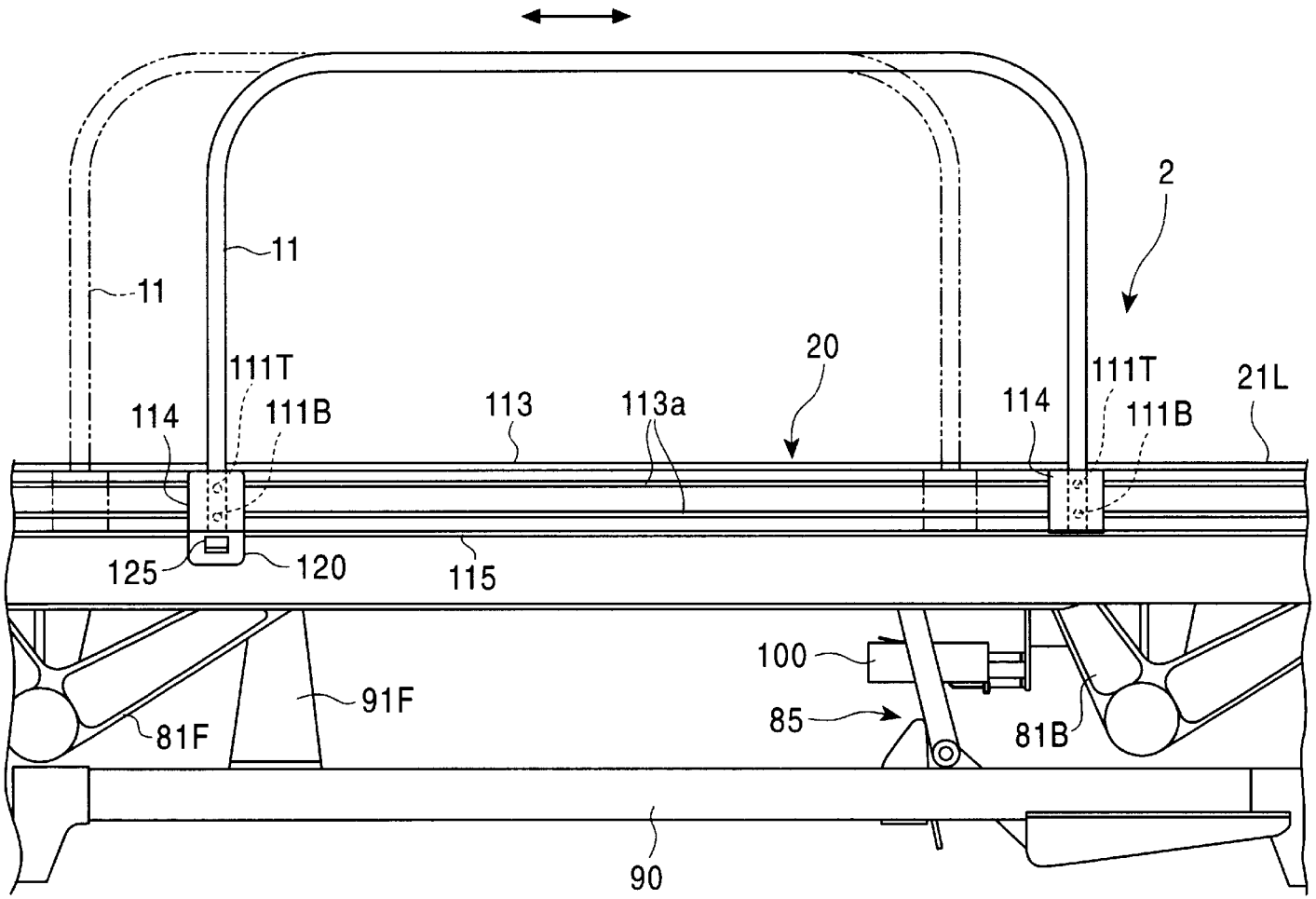
FIG. 24 is a side view showing the configuration of handrails of the variable bed according to the present invention.

As shown in FIGS. 2 and 24, the bedstead 20 of the fixed bed 2 has the handrails 11, 11 attached to both side surfaces thereof. The handrails 11 are configured so as to slide in the longitudinal direction as described below.

Figure 25:
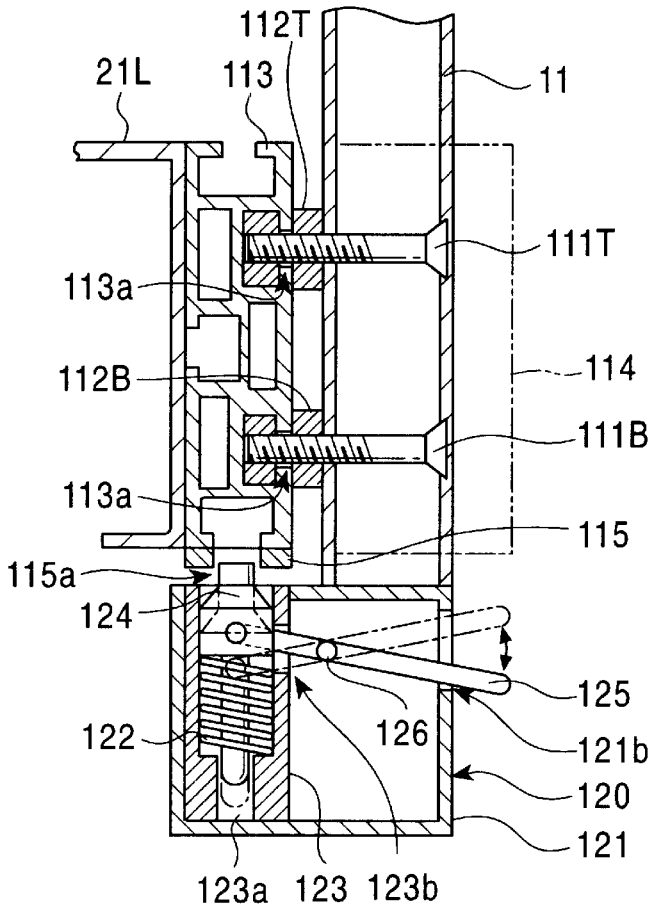
FIG. 25 is a front sectional view showing the configuration of a lower part of the handrails according to the present invention.
Figure 26:
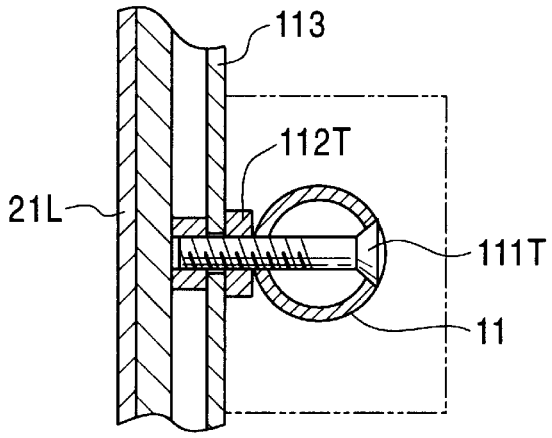
FIG. 26 is a top sectional view of FIG. 25.

As shown in FIGS. 24 to 26, the handrails 11 each comprises a pipe that appears substantially U-shaped as seen in a side view, and has two vertically-arranged screws 111T, 111B screwed in a lower end thereof from an outer side surface thereof in a manner such that tip portions of the screws 111T, 111B project from an inner side surface of the lower end. Further, the outer side surface of the lower end of the handrail 11 is covered with a cover 114 so as to cover head portions of the screws 111T, 111B.

On the other hand, rail members 113, 113 are disposed on the outer side surfaces of the left frame 21L and right frame 21R of the bedstead 20 so as to extend in the longitudinal direction. The rail members 113, 113 each have two vertically-arranged rail grooves 113*a*, 113*a* extending in the longitudinal direction. The screws 111T, 111B have slide guides 112T, 112B attached thereto and which are slidably fitted in the rail grooves 113*a*, 113*a* to thereby attach the handrails 11 to the rail members 113, 113 on both side surfaces of the bedstead 20.

Since the upper and lower slide guides 112T, 112B of the handrail 11 are fitted in the two vertically-arranged rail grooves 113*a*, 113*a* to thereby support the handrail 11 at the two points, the handrail 11 is prevented from overturning in the lateral direction.

Further, the handrail 11 has a stopper mechanism for regulating the longitudinal sliding of the handrail 11.

An example of the stopper mechanism will be explained (the stopper mechanism, however, is not limited to the embodiment shown below).

Figure 27:
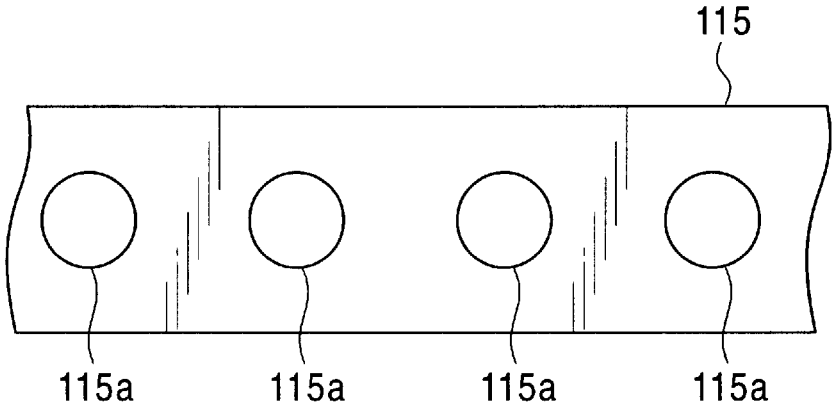
FIG. 27 is a partial top view of a plate for positioning the handrails.
Figure 28:
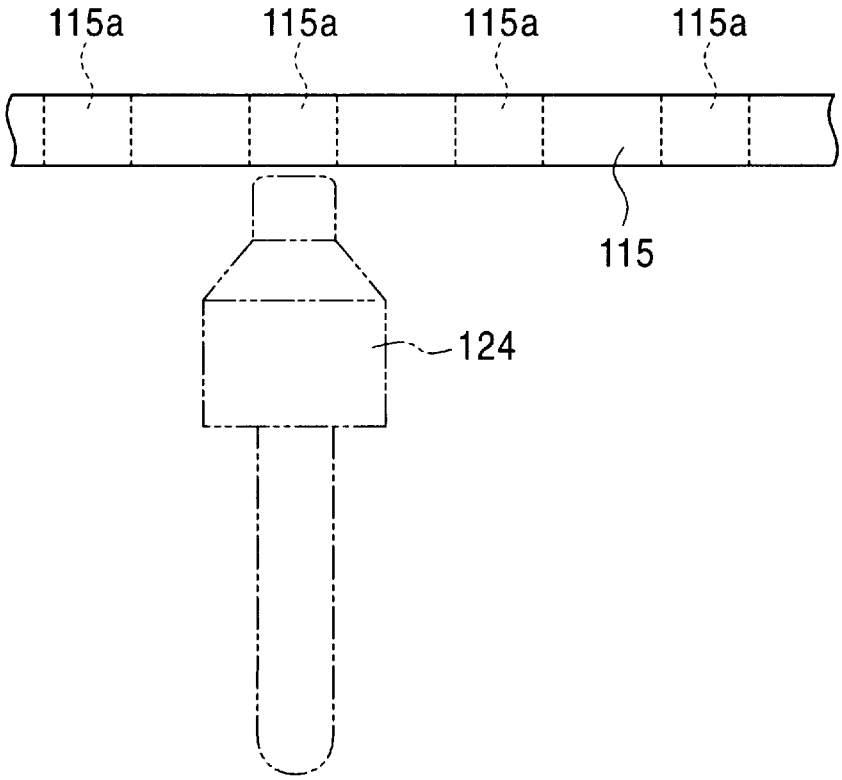
FIG. 28 is a partial side view of FIG. 27.

As shown in FIG. 24, the stopper mechanism comprises a positioning plate 115 and a stopper device 120, and the positioning plate 115 is disposed on a bottom surface of the rail member 113, and the stopper device 120 is disposed at a lower end of the handrail 11. In brief, as shown in FIGS. 27 and 28, the positioning plate 15 has a large number of pin holes 115*a*, 115*a* . . . formed therein at predetermined intervals in the longitudinal direction, and an index pin 124 of the stopper device 120 is fitted in one of the pin holes 115*a*, 115*a* . . . to fix the handrail 11.

That is, as shown in FIG. 25, the stopper device 120 comprises a casing 121, a spring 122, a spring receiver 123, an index pin 124, a switch lever 125, and the like. The screw receiver 123 is fixedly installed inside the casing 121 and closer to the interior of the main body. The spring 122 is disposed inside the spring receiver 123, and the index pin 124 is fittingly inserted into the spring 122. At this time, the spring receiver 123 is drilled in the center of an internal bottom surface thereof so that a lower end of the index pin 124 can be inserted through the drilled hole. Furthermore, a vertically elongate hole 121*b* is formed in an upper part of a side surface of the casing 121 which surface is closer to the exterior of the main body, and a switch lever 125 is passed through the elongate hole 121*b* and the elongate hole 123*b*. An inner end of the switch lever 125 and the index pin 124 are fittingly connected together. Further, the switch lever 125 has a rotationally moving fulcrum 126 at a longitudinally intermediate position thereof, and the rotationally moving point 126 is journaled between a front and a rear surfaces of the casing 121.

With such a configuration, when the switch lever 125 is pushed up, the index pin 121 is pushed down against the urging force of the spring 122 and its tip slips out from the pin hole 115*a* in the positioning plate 115, thus allowing the handrail 11 to slide freely. Then, the handrail 11 is moved to a desired position with the switch lever 125 kept pushed up by the finger. When the finger is taken off from the switch lever, the recovery force of the spring 122 causes the index pin 124 to be pushed up and fitted in one of the pin holes 115*a*, 115*a* . . . to fix the handrail 11.

The switch lever 125 may be urged toward the interior of the main body by means of a spring (not illustrated) so that when the spring passes beyond the fulcrum, the switch lever 125 is forced upward or downward within the elongate hole 121*b* in the casing 121.

Moreover, the vertical lengths of the elongate hole 123*b* in the spring receiver 123 and of the elongate hole 121*b* in the casing may be adjusted, so that when the switch lever 125 is pushed down, the upper end of the index pin 124 is loosely fitted in one of the pin holes 115*a*, 115*a* . . . If the user thus slides the handrails while feeling as if a detent was working, the user can determine the hole position by the feel for easy positioning.

The stopper mechanism may be configured to be able to position the handrail 11 in a non-step manner, or the fixed bed 2 may comprise the stopper mechanism.

Next, a method for mounting the variable bed 3 in the fixed bed 2 will be described.

As shown in FIGS. 19 and 20, the variable bed 3 has guide roller devices 13 and 13 disposed on both side surfaces thereof.

Figure 29:
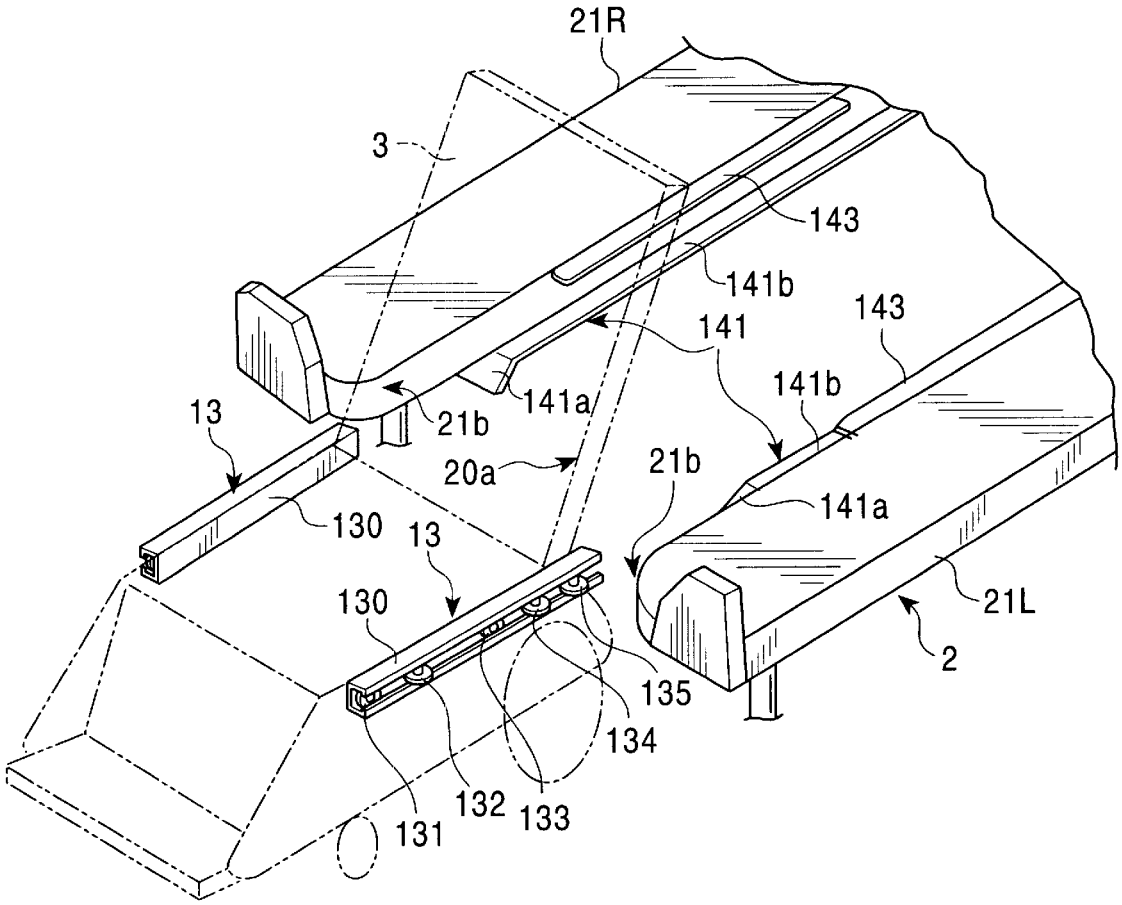
FIG. 29 is a perspective view showing the configuration of guide roller devices and guide members according to the present invention.
Figure 30:
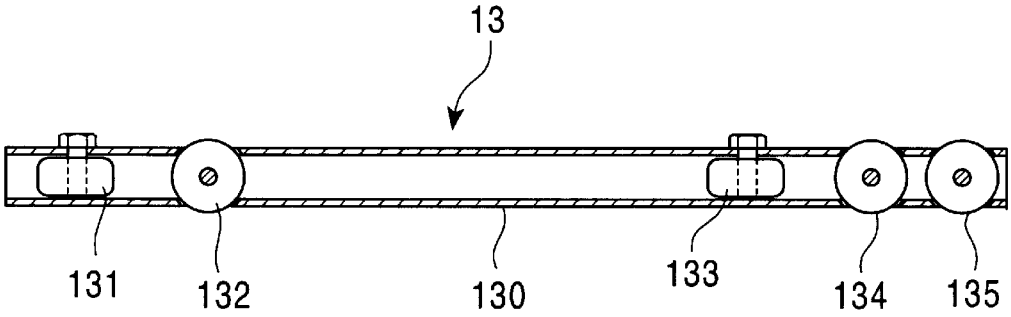
FIG. 30 is a top sectional view of the guide roller device according to the present invention.
Figure 31:
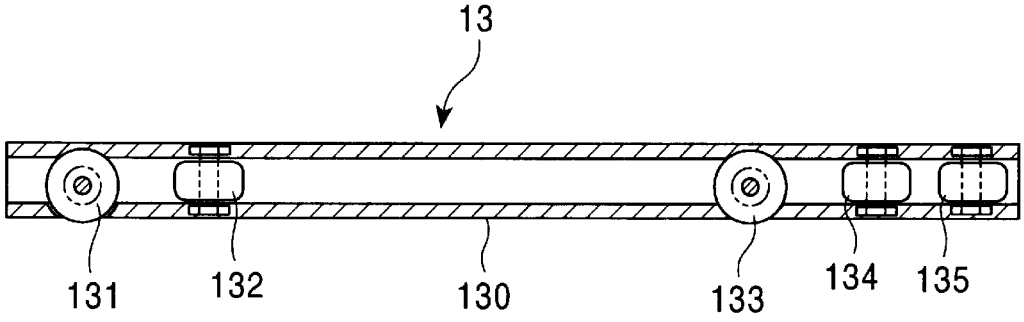
FIG. 31 is a side sectional view of FIG. 30.

As shown in FIGS. 29 to 31, the guide roller device 13 comprises vertical rollers 131, 133 having a laterally directed axis, horizontal rollers 132, 134 and 135 having a horizontally directed axis, a guide roller frame 130, and other components.

The vertical roller 131 is disposed at a front position of the guide roller frame 130, and the horizontal roller 132 is disposed slightly behind the vertical roller 131. Further, the vertical roller 133, the horizontal roller 134, and the horizontal roller 135 are disposed at rear positions of the guide roller frame in this order relative to the front end thereof. At this time, openings are formed in a bottom surface and a left and a right side surfaces of the guide roller frame 130, and roller rotating surfaces of the vertical rollers 131, 133 and horizontal rollers 132, 134 and 135 are projected through these openings. Then, as shown in FIGS. 19 and 20, the guide roller frame 130 is covered with a guide roller cover 136.

The locations of the horizontal and vertical rollers in the guide roller device 13 as well as the numbers of these rollers are not particularly limited.

Figure 6:
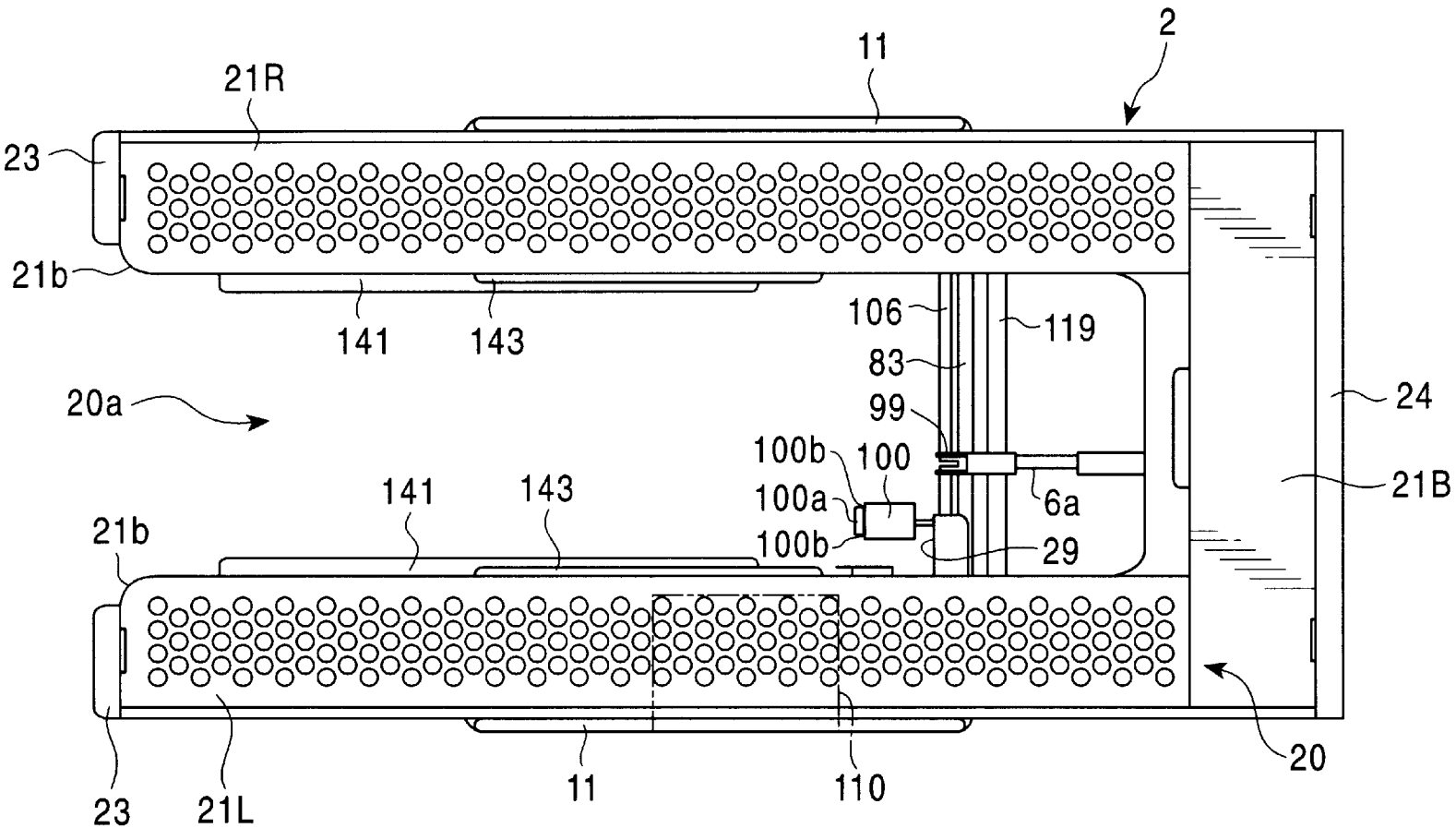
FIG. 6 is a top view showing the configuration of the fixed bed.

On the other hand, the inner corner of the front end of each of the left frame 21L and right frame 21R is rounded to form curved guide surfaces 21*b*, 21*b* as shown in FIGS. 6 and 29. The guide surfaces 21*b*, 21*b* are smooth curved surfaces having a center of curvature at the front end of each of the left and right frames.

The guide surfaces may be flattened by chamfering the inner corner of the front end of each of the left frame 21L and right frame 21R, that is, obliquely cutting the inner corner so that the interval between the left frame 21L and right frame 21R is larger at the front end. The structure of the guide surfaces is not particularly limited as long as they allow the variable bed 3 to be easily moved into the fixed bed.

Then, supporting guide members 141, 141 are each installed along a lower part of the inner side surface of each of the left frame 21L and right frame 21R so as to project therefrom, and front portions of the supporting guide members 141, 141 are bent obliquely downward to form inclined surfaces 141*a*, 141*a*.

With this configuration, if the variable bed 3 in the wheelchair form is moved into the notched recess portion 20*a* of the fixed bed 2 and even if the variable bed 3 is moved in an oblique direction, the guide surfaces 21*b*, 21*b* of the left frame 21L and right frame 21R of the fixed bed 2 guide the horizontal rollers 135, 135 of the guide roller devices 13, 13 attached to both side surfaces of the variable bed 3 to modify the angle at which the variable bed is moved. This enables the variable bed 3 to move into the fixed bed 2 from immediately before it.

Then, the horizontal rollers 134, 134 and 135, 135 are guided by the inner side surfaces of the left frame 21L and right frame 21R of the fixed bed. The straight advancement of the variable bed 3 is retained by the horizontal rollers 134, 135 installed in the longitudinal direction, thus allowing the variable bed 3 to be smoothly moved into the notched recess portion 20*a* of the fixed bed 2.

In this case, the inclined surfaces 141*a*, 141*a* of the supporting guide members 141, 141 provided on the inner side surfaces of the left frame 21L and right frame 21R guide the vertical rollers 133, 133 of the guide roller devices 13, 13 to bring the variable bed 3 upward and rearward along horizontal surfaces 141*b*, 141*b* of the supporting guide members 141, 141.

When the variable bed 3 is pushed along the supporting guide members 141, 141 up to an innermost portion of the notched recess portion 20*a* of the fixed bed 2, the plug 101 of the variable bed 3 shown in FIG. 14 is fitted in the receptacle 100 of the fixed bed 2 shown in FIG. 6 to enable a power supply to the variable bed 3.

In this manner, the variable bed 3 is fitted in the fixed bed 2 and is changed from the wheelchair form to the horizontal bed form. At this time, as the seat back portion 33 is inclined in a direction in which it extends horizontally, the center of gravity of the variable bed 3 and the patient lying thereon is displaced rearward.

Then, overturn-preventing guide members 143, 143 are each installed along an upper part of the inner side surface of each of the left frame 21L and right frame 21R of the fixed bed 2 so as to project inward. Thus, the overturn-preventing guide member 143 is disposed substantially parallel with the supporting guide member 141 so that the guide roller devices 13, 13 of the variable bed 3 can each be inserted between the corresponding overturn-preventing guide members 143 and supporting guide member 141.

With this configuration, even if the center of gravity of the variable bed 3 moves rearward, top surfaces of the guide roller devices 13, 13 abut against bottom surfaces of overturn-preventing guide members 143, 143 to support the variable bed 3, thereby enabling a stable change to the horizontal bed position.

With the above configurations, the present invention provides the following effects.

The present invention provides a multifunctional bed comprising a variable bed that can be changed into a wheelchair form and a fixed bed in which the variable bed can be removably fitted, wherein a holding member is provided between the fixed bed and the variable bed, for holding a vertical position of the variable bed relative to the fixed bed. Accordingly, when the seat back portion of the variable bed is laid or raised, even if the center of gravity of the patient's weight is displaced rearward beyond the positions of the rear wheels of the variable bed, the holding member holds the vertical position of the variable bed to enable the variable bed to change its form stably and smoothly.

The holding member comprises a lateral pair of guiding members disposed on an inner surface of a notched recess portion of the fixed bed formed so as to appear substantially U-shaped, and a pair of guided members disposed on both sides of a seat portion of the variable bed. Consequently, the guiding members and the guided members hold the vertical position of the variable bed to enable the variable bed to change its form stably and smoothly, as described above.

Further, even when the variable bed is moved into or separated from the notched recess portion of the fixed bed, the guiding members and the guided members hold the vertical position of the variable bed to allow the variable bed to be stably and smoothly guided in the longitudinal direction, thus enabling the variable bed to be easily moved into or separated from the fixed bed.

The guiding members comprise a vertical pair of guide rails and the guided members comprise guide rollers guided along the vertical pair of guide rails. The vertical pairs of guide rails and rollers hold the vertical position of the variable bed to enable the variable bed to change its form stably and smoothly, as described above.

Further, even when the variable bed is moved into or separated from the notched recess portion of the fixed bed, the guiding members and the guided members hold the vertical position of the variable bed to allow the variable bed to be stably and smoothly guided in the longitudinal direction, thus enabling the variable bed to be easily moved into or separated from the fixed bed.

With the above configurations, the present invention has the following effects:

The present invention provides a multifunctional bed comprising a variable bed that can be changed into a wheelchair form and a fixed bed in which the variable bed can be removably fitted, wherein guide rollers are disposed at rear positions of a seat portion of the variable bed, for guiding the fixed bed so as to move into the notched recess portion. Accordingly, when the variable bed is moved into the notched recess portion of the fixed bed, this operation can be preformed easily and smoothly without causing the variable bed to interfere with the inner side surfaces of the fixed bed.

The present invention also provides a multifunctional bed comprising a variable bed that can be changed into a wheelchair form and a fixed bed in which the variable bed can be removably fitted, wherein guide rollers for guiding the fixed bed so as to enter or leave a notched recess portion are disposed on a front and a rear positions of both sides of a seat portion of the variable bed. Accordingly, when the variable bed is moved into the notched recess portion of the fixed bed, this operation can be preformed easily and smoothly without causing the variable bed to interfere with the inner side surfaces of the fixed bed.

The present invention also provides a multifunctional bed comprising a variable bed that can be changed into a wheelchair form and a fixed bed in which the variable bed can be removably fitted, wherein guide surfaces for guiding the variable bed so as to advance into a notched recess portion are formed in a left and right inner sides of a front end surface of the fixed bed, the front end surface having the notched recess portion opened therein.

With the above configurations, the present invention has the following effects:

As set forth in claim 1, the present invention provides a multifunctional bed comprising a variable bed that can be changed into a wheelchair form and a fixed bed in which the variable bed can be removably fitted, wherein handrails are provided along peripheries of the fixed bed so as to stand up therefrom and are movable. Accordingly, when the caregiver helps the patient into or out from the multifunctional bed, the caregiver can easily perform this operation from either side of the fixed bed simply by moving the handrails of the fixed bed and without avoiding the handrails.

Further, when moving or separating the variable bed in the wheelchair form into or from the notched recess portion of the fixed bed, the caregiver can easily carry out this movement or separation from either side of the fixed bed by moving the handrails to a position where they do not interfere with the operation. Consequently, the caregiver can easily care for and look after the patient.

When the handrails are configured to slide along peripheral portions of the fixed bed as set forth in claim 2, effects similar to those of claim 1 are obtained. Further, the caregiver can easily help the patient into or out from the multifunctional bed from either side of the fixed bed, and can easily perform nursing and other operations from either side of the fixed bed by moving the handrails to a position where they do not interfere with the operations.

As set forth in claim 3, the handrails are attached to the fixed bed by slidably fitting slide guides fixedly installed on the handrails, in rails provided along the peripheral portions of the fixed bed, and the handrail side or the fixed bed side has a stopper mechanism for regulating sliding of the handrails. Then, effects similar to those of claim 1 are obtained, and the stopper mechanism can be used to fix the handrails to thereby improve the safety of operations and the like.

What is claimed is:

1. A multifunctional bed comprising a variable bed that can be changed into a wheelchair and a fixed bed in which the variable bed can be removably fitted, wherein a holding member is provided between the fixed bed and the variable bed, for holding up the wheelchair relative to the fixed bed; wherein any wheels of the wheelchair are not in contact with a floor; and wherein a pair of guide roller devices is mounted on two opposite sides of the variable bed, each guide roller device comprises at least one vertically oriented roller and at least one horizontally oriented roller.

2. A multifunctional bed according to claim 1, characterized in that said holding member comprises a lateral pair of guiding members disposed on an inner surface of a notched recess portion of the fixed bed formed so as to appear substantially U-shaped, and a pair of guided members disposed on both sides of a seat portion of the variable bed.

3. A multifunctional bed according to claim 2, characterized in that said guiding members comprise a vertical pair of guide rails and said guided members comprise guide rollers guided along the vertical pair of guide rails.

4. A multifunctional bed comprising a variable bed that can be changed into a wheelchair form and a fixed bed in which the variable bed can be removably fitted, wherein a plurality of guide roller devices are each disposed on opposite sides of a seat portion of the variable bed each guide roller device comprises at least one vertically oriented roller and at least one horizontally oriented roller for guiding the fixed bed so as to move into a notched recess portion.

5. A multifunctional bed comprising a variable bed that can be changed into a wheelchair form and a fixed bed in which the variable bed can be removably fitted, the variable bed comprising a plurality of guide rollers disposed on a front and a rear positions of both sides of a seat portion of the variable bed for guiding the variable bed into or out of a notched recess portion of the fixed bed.

6. A multifunctional bed comprising a variable bed that can be changed into a wheelchair and a fixed bed in which the variable bed can be removably fitted, the multifunctional bed being characterized in that a pair of curved guide surfaces for guiding the variable bed so as to advance into a notched recess portion are formed in a left and right inner sides of a front end surface of the fixed bed, the front end surface having the notched recess portion opened therein; wherein a pair of guide roller devices is mounted on two opposite sides of the variable bed, each guide roller device comprises at least one vertically oriented roller and at least one horizontally oriented roller.

7. A multifunctional bed comprising a variable bed that can be changed in to a wheelchair form and a fixed bed in which the variable bed can be removably fitted, the multifunctional bed being characterized in that handrails are provided along peripheries of the fixed bed so as to stand up therefrom and are movable; wherein a pair of guide roller devices is mounted on two opposite sides of the variable bed, each guide roller device comprises at least one vertically oriented roller and at least one horizontally oriented roller.

8. A multifunctional bed according to claim 7 characterized in that said handrails are configured to slide along peripheral portions of the fixed bed.

9. A multifunctional bed according to claim 7 or claim 8, characterized in that said handrails are attached to the fixed bed by slidably fitting slide guides fixedly installed on the handrails, said rails provided along the peripheral portions of the fixed bed, and the handrails or the fixed bed has a stopper mechanism for regulating sliding of the handrails.

* * * * *